US007618106B2

(12) United States Patent
Usui

(10) Patent No.: US 7,618,106 B2
(45) Date of Patent: Nov. 17, 2009

(54) LIQUID EJECTION HEAD CONTROL METHOD AND LIQUID EJECTION HEAD CONTROL APPARATUS

(75) Inventor: Toshiki Usui, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 457 days.

(21) Appl. No.: 11/705,050

(22) Filed: Feb. 12, 2007

(65) Prior Publication Data

US 2008/0012888 A1 Jan. 17, 2008

(30) Foreign Application Priority Data

Feb. 13, 2006 (JP) ..... 2006-035708

(51) Int. Cl.
*B41J 29/38* (2006.01)

(52) U.S. Cl. ..... 347/9

(58) Field of Classification Search ..... None
See application file for complete search history.

(56) References Cited

U.S. PATENT DOCUMENTS 5,936,644 A * 8/1999 Ono et al. ..... 347/10
6,331,052 B1 * 12/2001 Murai et al. ..... 347/68
6,354,686 B1 * 3/2002 Tanaka et al. ..... 347/11

FOREIGN PATENT DOCUMENTS

JP 2003-309701 A 10/2003
JP 2005-136702 A 5/2005

* cited by examiner

*Primary Examiner*—Matthew Luu
*Assistant Examiner*—Justin Seo
(74) *Attorney, Agent, or Firm*—Sughrue Mion, PLLC

(57) ABSTRACT

The negative influence of noise is reduced. A liquid ejection head control method involves (A) simultaneously generating a first drive signal and a second drive signal in a particular period, (B) generating a plurality of first timing pulses and a plurality of second timing pulses, and (C) causing an operation of an element in the liquid ejection head and that performs at least an operation for causing liquid to be ejected. The first drive signal has a plurality of first waveform sections whose voltages change from a reference voltage, follow voltage change patterns determined in correspondence with operations to be performed by the element, and then return to the reference voltage. The second drive signal has a plurality of second waveform sections whose voltages change from the reference voltage, follow voltage change patterns determined in correspondence with operations to be performed by the element, and then return to the reference voltage. The first timing pulse corresponding to a first waveform section that is different from a particular first waveform section and that is generated subsequently after the particular first waveform section, and the second timing pulse corresponding to a second waveform section that is different from a particular second waveform section and that is generated subsequently after the particular second waveform section, are generated at different timings, in an overlap period between generation periods of the reference voltage, one of the generation periods being from a generation end timing of the voltage change pattern in the particular first waveform section to a generation start timing of the voltage change pattern in the different first waveform section, the other generation period being from a generation end timing of the voltage change pattern in the particular second waveform section to a generation start timing of the voltage change pattern in the different second waveform section. The element operates in response to application of either one of the first waveform section and the second waveform section to the element at a timing prescribed by either one of the first timing pulse and the second timing pulse.

9 Claims, 14 Drawing Sheets

| | DRIVE PULSE TO BE APPLIED | | | EJECTION AMOUNT |
|---|---|---|---|---|
| NONE (000) | — | — | — | 0 PL |
| | 4TH | — | — | |
| SMALL 1 (001) | — | — | — | APPROX. 1.5 PL |
| | — | 5TH | — | |
| SMALL 2 (100) | — | — | 3RD | APPROX. 3 PL |
| | — | — | — | |
| MEDIUM 1 (010) | — | 2ND | — | APPROX. 7 PL |
| | — | — | — | |
| MEDIUM 2 (101) | — | 2ND | — | APPROX. 14 PL |
| | — | — | 6TH | |
| LARGE (011) | 1ST | 2ND | — | APPROX. 21 PL |
| | — | — | 6TH | |

LIQUID EJECTION HEAD CONTROL METHOD AND LIQUID EJECTION HEAD CONTROL APPARATUS

CROSS-REFERENCE TO RELATED APPLICATIONS

The present application claims priority upon Japanese Patent Application No. 2006-35708 filed on Feb. 13, 2006, which is herein incorporated by reference.

BACKGROUND

1. Technical Field

The present invention relates to liquid ejection head control methods and liquid ejection head control apparatuses.

2. Related Art

Liquid ejection heads and control apparatuses for controlling the liquid ejection heads are used in liquid ejecting apparatuses such as inkjet printers. These control apparatuses include a device that simultaneously generates a plurality of drive signals at a printing cycle, and selectively applies drive pulses contained in the drive signals to piezo elements in a liquid ejection head (see JP-A-2000-52570, for example). The selective application of the drive pulses is performed, for example, by applying waveform sections in the drive signals to the piezo elements at a timing prescribed by a latch pulse or change pulse (also referred to as a "channel pulse") (see JP-A-H10-81013, for example).

In a case where the waveform sections in the drive signals are selectively applied to the piezo elements at the timing of the latch pulse or change pulse, noise may be generated in the drive signals. It seems that the noise is generated because the amount of current to the piezo elements suddenly changes. For example, in a case where waveform sections are applied to a large number of piezo elements, at the moment when the application is stopped all at once, the ground potential changes and the change may appear as noise in the drive signals. There is no problem when the noise generated in the drive signals is small, but excessively large noise may pose a problem for ejection of ink.

SUMMARY

An advantage of some aspects of the present invention is that it is possible to reduce the negative influence of noise.

An aspect of the present invention is a liquid ejection head control method as below.

A liquid ejection head control method includes:

(A) simultaneously generating a first drive signal and a second drive signal in a particular period, wherein the first drive signal has a plurality of first waveform sections whose voltages change from a reference voltage, follow voltage change patterns determined in correspondence with operations to be performed by an element that is in the liquid ejection head and that performs at least an operation for causing liquid to be ejected, and then return to the reference voltage, and the second drive signal has a plurality of second waveform sections whose voltages change from the reference voltage, follow voltage change patterns determined in correspondence with operations to be performed by the element, and then return to the reference voltage, (B) generating a plurality of first timing pulses that indicate generation start timings of the first waveform sections, respectively in correspondence with the plurality of first waveform sections, and generating a plurality of second timing pulses that indicate generation start timings of the second waveform sections, respectively in correspondence with the plurality of second waveform sections, wherein the first timing pulse corresponding to a first waveform section that is different from a particular first waveform section and that is generated subsequently after the particular first waveform section, and the second timing pulse corresponding to a second waveform section that is different from a particular second waveform section and that is generated subsequently after the particular second waveform section are generated at different timings, in an overlap period between generation periods of the reference voltage, one of the generation periods being from a generation end timing of the voltage change pattern in the particular first waveform section to a generation start timing of the voltage change pattern in the different first waveform section, the other generation period being from a generation end timing of the voltage change pattern in the particular second waveform section to a generation start timing of the voltage change pattern in the different second waveform section, and (C) applying either one of the first waveform section and the second waveform section to the element at a timing prescribed by either one of the first timing pulse and the second timing pulse, thereby causing the element to operate in accordance with the voltage change pattern in the applied waveform section.

Other features of the present invention will become clear through the accompanying drawings and the following description.

BRIEF DESCRIPTION OF THE DRAWINGS

For a more complete understanding of the present invention and the advantages thereof, reference is now made to the following description taken in conjunction with the accompanying drawings.

DESCRIPTION OF EXEMPLARY EMBODIMENTS

Figure 1:
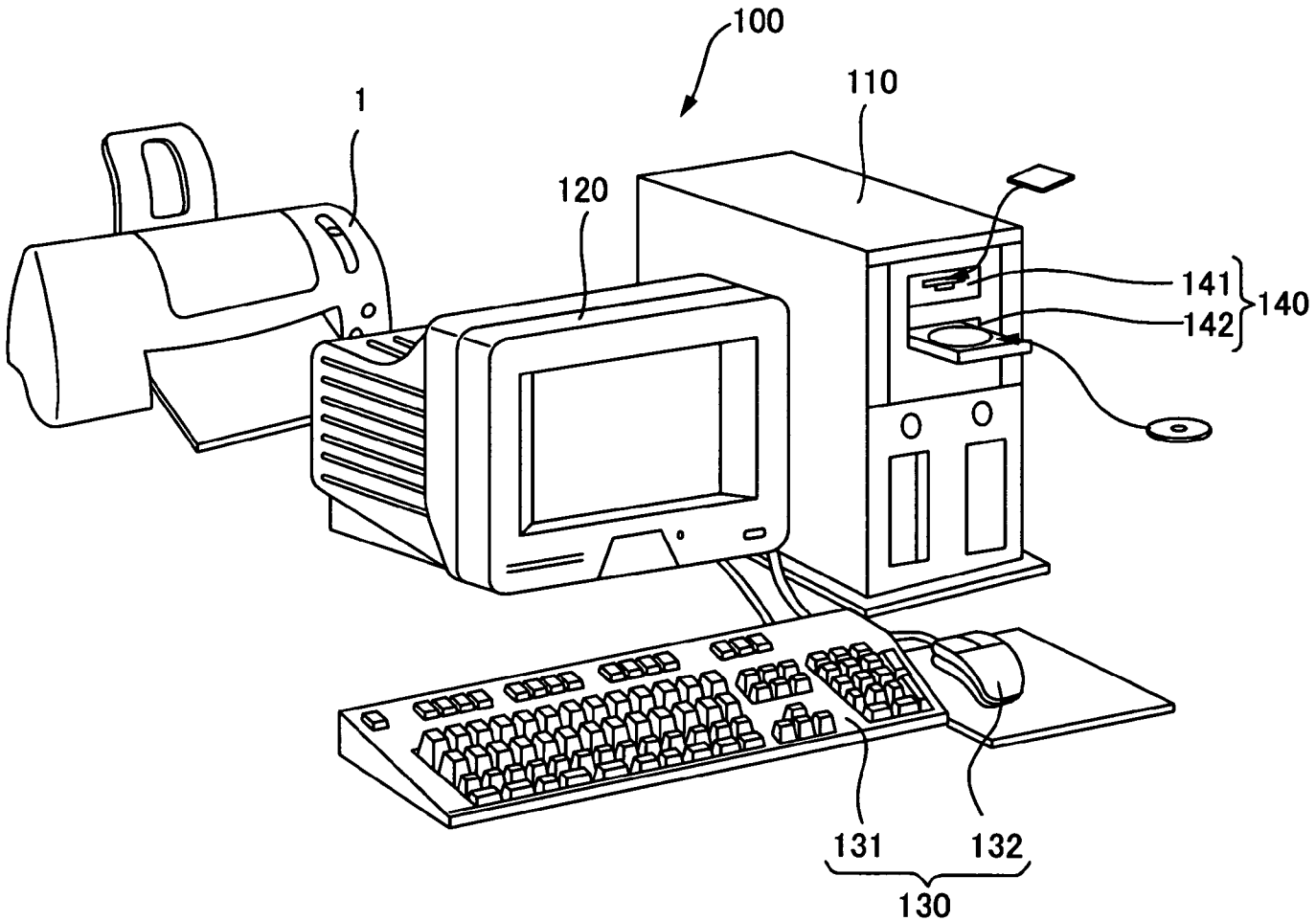
FIG. 1 is a view illustrating the configuration of a printing system.

At least the following matters will be made clear by the description of the present specification and the accompanying drawings.

A liquid ejection head control method, comprises: (A) simultaneously generating a first drive signal and a second drive signal in a particular period, wherein the first drive signal has a plurality of first waveform sections whose voltages change from a reference voltage, follow voltage change patterns determined in correspondence with operations to be performed by an element that is in the liquid ejection head and that performs at least an operation for causing liquid to be ejected, and then return to the reference voltage, and the second drive signal has a plurality of second waveform sections whose voltages change from the reference voltage, follow voltage change patterns determined in correspondence with operations to be performed by the element, and then return to the reference voltage, (B) generating a plurality of first timing pulses that indicate generation start timings of the first waveform sections, respectively in correspondence with the plurality of first waveform sections, and generating a plurality of second timing pulses that indicate generation start timings of the second waveform sections, respectively in correspondence with the plurality of second waveform sections, wherein the first timing pulse corresponding to a first waveform section that is different from a particular first waveform section and that is generated subsequently after the particular first waveform section, and the second timing pulse corresponding to a second waveform section that is different from a particular second waveform section and that is generated subsequently after the particular second waveform section are generated at different timings, in an overlap period between generation periods of the reference voltage, one of the generation periods being from a generation end timing of the voltage change pattern in the particular first waveform section to a generation start timing of the voltage change pattern in the different first waveform section, the other generation period being from a generation end timing of the voltage change pattern in the particular second waveform section to a generation start timing of the voltage change pattern in the different second waveform section, and (C) applying either one of the first waveform section and the second waveform section to the element at a timing prescribed by either one of the first timing pulse and the second timing pulse, thereby causing the element to operate in accordance with the voltage change pattern in the applied waveform section.

With this liquid ejection head control method, the first timing pulse corresponding to the different first waveform section and the second timing pulse corresponding to the different second waveform section are generated at different timings. Thus, it is possible to prevent noise generated due to the first timing pulse and noise generated due to the second timing pulse from being superimposed. Accordingly, it is possible to prevent the problem that excessively large noise is generated, so that it is possible to prevent problems such as ejection failure of ink.

In the liquid ejection head control method, it is preferable that first selection data for selecting the first waveform section is updated at a timing prescribed by the first timing pulse, and application of the first drive signal to the element is controlled based on the first selection data, and that second selection data for selecting the second waveform section is updated at a timing prescribed by the second timing pulse, and application of the second drive signal to the element is controlled based on the second selection data.

With this liquid ejection head control method, it is possible to easily apply the first waveform sections and the second waveform sections to the element.

In the liquid ejection head control method, it is preferable that the first selection data is updated at a timing of an edge in the first timing pulse, that the second selection data is updated at a timing of an edge in the second timing pulse, and that the first timing pulse corresponding to the different first waveform section and the second timing pulse corresponding to the different second waveform section are generated at different timings such that the timing of the edge in the first timing pulse is different from the timing of the edge in the second timing pulse.

With this liquid ejection head control method, it is possible to reliably prevent noise generated due to the first timing pulse and noise generated due to the second timing pulse from being superimposed.

In the liquid ejection head control method, it is preferable that in a case where the different second waveform section is applied to the element after the particular first waveform section is applied to the element, the second timing pulse corresponding to the different second waveform section is generated after the first timing pulse corresponding to the different first waveform section.

With this liquid ejection head control method, in a case where a waveform section applied to the piezo element is switched from the first waveform section to the second waveform section, it is possible to reliably prevent the problem that the first drive signal and the second drive signal are simultaneously applied to the element.

In the liquid ejection head control method, it is preferable that a generation period of at least one of the voltage change patterns respectively in the plurality of first waveform sections is made different from a generation period of at least one of the voltage change patterns respectively in the plurality of second waveform sections.

With this liquid ejection head control method, the generation periods of the first drive signal and the second drive signal can be optimized in accordance with the generation periods of the voltage change patterns. Thus, it is possible to efficiently generate a plurality of waveform sections even in a limited period.

In the liquid ejection head control method, it is preferable that the liquid ejection head is for changing a volume of a pressure chamber that is in communication with a nozzle, with an operation of the element, that at least one of the voltage change patterns respectively in the plurality of first waveform sections and the plurality of second waveform sections is for changing the volume of the pressure chamber such that a predetermined amount of liquid is ejected from the nozzle, and that at least another one of the voltage change patterns is for changing the volume of the pressure chamber to the extent that liquid is not ejected from the nozzle.

With this liquid ejection head control method, it is possible to cause various operations even in a limited period.

In the liquid ejection head control method, it is preferable that the first drive signal and the second drive signal are repeatedly generated taking the particular period as a repeating unit.

With this liquid ejection head control method, it is possible to easily generate the first drive signal and the second drive signal.

In the liquid ejection head control method, it is preferable that the first drive signal and the second drive signal are generated by reading, every update cycle, data that is stored for each update cycle and that indicates the voltage of the first drive signal in the particular period, and data that is stored for each update cycle and that indicates the voltage of the second drive signal in the particular period, and that the first timing pulses and the second timing pulses are generated by reading, every update cycle, data that is stored for each update cycle and that indicates a generation state of the first timing pulses in the particular period, and data that is stored for each update cycle and that indicates a generation state of the second timing pulses in the particular period.

With this liquid ejection head control method, it is possible to generate the first timing pulses and the second timing pulses in synchronization with the first drive signal and the second drive signal.

Furthermore, it has been made clear that a liquid ejection head control device as below can be realized.

A liquid ejection head control device comprises: (A) a drive signal generating section for simultaneously generating a first drive signal and a second drive signal in a particular period, wherein the first drive signal has a plurality of first waveform sections whose voltages change from a reference voltage, follow voltage change patterns determined in correspondence with operations to be performed by an element that is in the liquid ejection head and that performs at least an operation for causing liquid to be ejected, and then return to the reference voltage, and the second drive signal has a plurality of second waveform sections whose voltages change from the reference voltage, follow voltage change patterns determined in correspondence with operations to be performed by the element, and then return to the reference voltage, (B) a timing pulse generating section for generating a plurality of first timing pulses that indicate generation start timings of the first waveform sections, respectively in correspondence with the plurality of first waveform sections, and generating a plurality of second timing pulses that indicate generation start timings of the second waveform sections, respectively in correspondence with the plurality of second waveform sections, wherein the first timing pulse corresponding to a first waveform section that is different from a particular first waveform section and that is generated subsequently after the particular first waveform section, and the second timing pulse corresponding to a second waveform section that is different from a particular second waveform section and that is generated subsequently after the particular second waveform section are generated at different timings, in an overlap period between generation periods of the reference voltage, one of the generation periods being from a generation end timing of the voltage change pattern in the particular first waveform section to a generation start timing of the voltage change pattern in the different first waveform section, the other generation period being from a generation end timing of the voltage change pattern in the particular second waveform section to a generation start timing of the voltage change pattern in the different second waveform section, and (C) a signal applying section for applying the first waveform sections and the second waveform sections to the element, wherein the signal applying section applies either one of the first waveform section and the second waveform section to the element at a timing prescribed by either one of the first timing pulse and the second timing pulse, thereby causing the element to operate in accordance with the voltage change pattern in the applied waveform section.

First Embodiment

Regarding the Liquid Ejecting Apparatus

There are various types of liquid ejecting apparatuses, such as printing apparatuses, color filter manufacturing apparatuses, display manufacturing apparatuses, semiconductor manufacturing apparatuses, and DNA chip manufacturing apparatuses, and thus it is difficult to describe all of these types of apparatuses. Thus, in this specification, a description is made taking, as an example, an inkjet printer (hereinafter, also referred to simply as a "printer") as a printing apparatus, and a printing system having this printer. It should be noted that the printing system refers to a system that has at least a printing apparatus and a print control apparatus for controlling the operation of this printing apparatus.

Configuration of Printing System 100

First, a printing apparatus is described along with a printing system 100. Herein, FIG. 1 is a view illustrating the configuration of the printing system 100. The illustrated printing system 100 includes a printer 1 as a printing apparatus and a computer 110 as a print control apparatus. More specifically, the printing system 100 has the printer 1, the computer 110, a display device 120, an input device 130, and a recording and reproducing device 140.

The printer 1 prints images on media such as paper, cloth, and film. It should be noted that the media correspond to targets to which liquid is to be ejected. In the following description, paper S (see FIG. 3), which is a typical medium, is taken as an example. The computer 110 is communicably connected to the printer 1. In order to print an image with the printer 1, the computer 110 outputs print data corresponding to that image to the printer 1. The computer 110 has computer programs such as an application program and a printer driver installed therein. The display device 120 has a display. The input device 130 is, for example, a keyboard 131 and a mouse 132. The recording and reproducing device 140 is, for example, a flexible disk drive device 141 and a CD-ROM drive device 142.

Computer 110

Regarding the Configuration of the Computer 110

Figure 2:
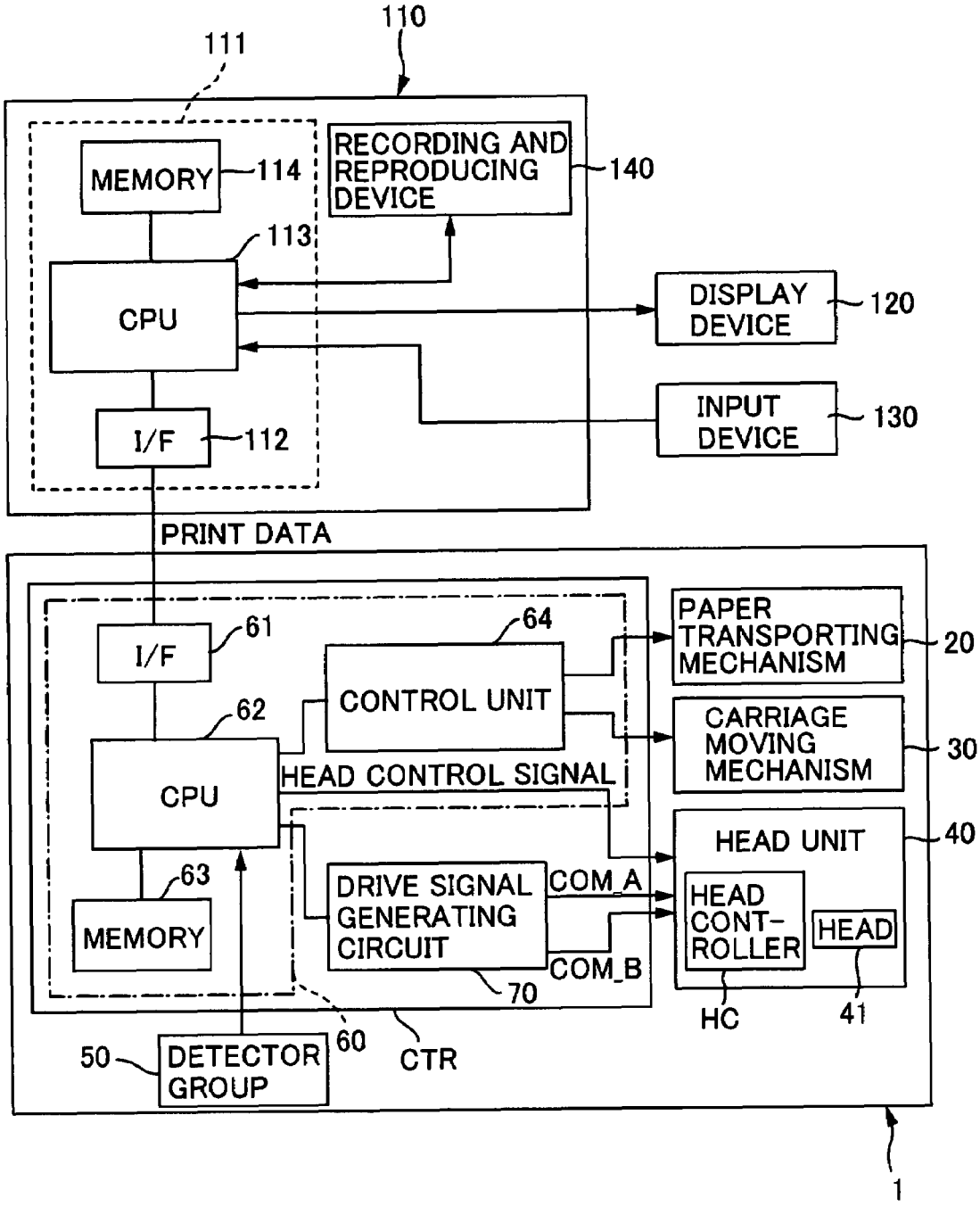
FIG. 2 is a block diagram illustrating the configuration of a computer and a printer.

FIG. 2 is a block diagram illustrating the configuration of the computer 110 and the printer 1. First, the configuration of the computer 110 is briefly described. The computer 110 has the above-described recording and reproducing device 140 and a host-side controller 111. The recording and reproducing device 140 is communicably connected to the host-side controller 111 and attached to, for example, a casing of the computer 110. The host-side controller 111 performs various controls in the computer 110 and is also communicably connected to the above-described display device 120 and input device 130. The host-side controller 111 has an interface section 112, a CPU 113, and a memory 114. The interface section 112 exchanges data with the printer 1. The CPU 113 is a computation processing unit for performing the overall control of the computer 110. The memory 114 is for reserving an area for storing computer programs used by the CPU 113 and a working area, for example, and is constituted by a RAM, an EEPROM, a ROM, or a magnetic disk device, for example. Examples of the computer programs that are stored in the memory 114 include the application program and the printer driver, as described above. The CPU 113 performs various controls following the computer programs stored in the memory 114.

Figure 9:
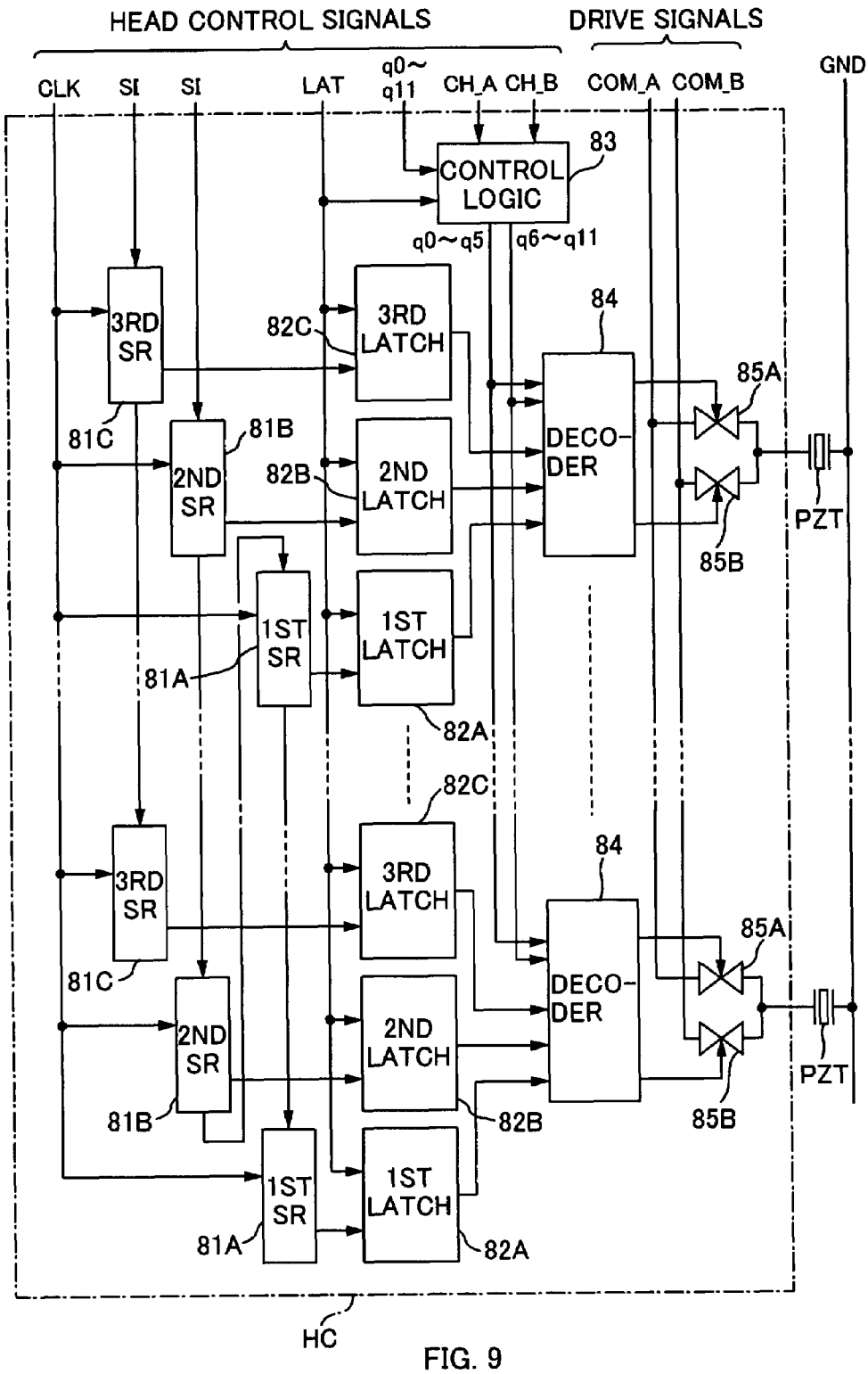
FIG. 9 is a diagram for illustrating the configuration of a head controller.

The print data is data in a format that can be interpreted by the printer 1, and has various types of command data and dot forming data SI (see FIG. 9). The command data is data for directing the printer 1 to execute a particular operation. Examples of the command data include command data for directing paper-feed, command data indicating the transport amount, and command data for directing paper-discharge. The dot forming data SI is data relating to dots that are to be formed on the paper S (data for dot color and size, for example), and is generated for each unit region. Herein, the unit region refers to a rectangular region that is virtually defined on a medium such as the paper S, and its size and shape are determined based on the print resolution. The dot forming data SI in this embodiment is constituted by dot tone data indicating the size of a dot. The size of a dot is determined by the amount of ink (a type of liquid) that is to be ejected. Thus, the dot forming data SI corresponds to ejection amount information indicating the amount of ink that is to be ejected. The tone data is constituted by 3 bits of data. For example, the dot forming data SI includes data [000] corresponding to formation of no dot (ink is not ejected), data [001] corresponding to formation of a first small dot, data [100] corresponding to formation of a second small dot, data [010] corresponding to formation of a first medium dot, data [101] corresponding to formation of a second medium dot, and data [011] corresponding to formation of a large dot. Thus, the printer 1 can form an image in 6 tones per unit region.

Printer 1

Regarding the Configuration of the Printer 1

Figure 3:
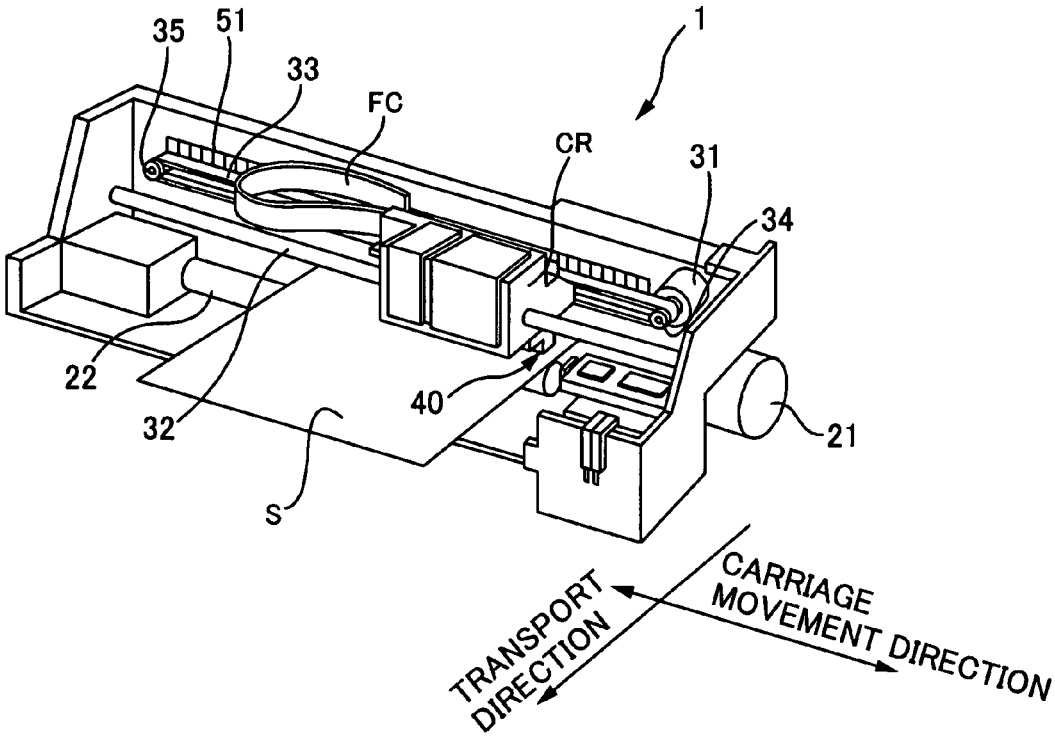
FIG. 3 is a diagram showing the configuration of the printer.

Next, the configuration of the printer 1 is described. Herein, FIG. 3 is a diagram showing the configuration of the printer 1 of this embodiment. In the following description, reference is made also to FIG. 2.

As shown in FIG. 2, the printer 1 has a paper transporting mechanism 20, a carriage moving mechanism 30, a head unit 40, a detector group 50, a printer-side controller 60, and a drive signal generating circuit 70. In this embodiment, the printer-side controller 60 and the drive signal generating circuit 70 are provided on a common controller board CTR. Moreover, the head unit 40 has a head controller HC and a head 41. In the printer 1, the printer-side controller 60 controls the sections that are to be controlled, that is, the paper transporting mechanism 20, the carriage moving mechanism 30, the head unit 40 (the head controller HC and the head 41), and the drive signal generating circuit 70. Thus, based on the print data received from the computer 110, the printer-side controller 60 causes an image to be printed on the paper S. Moreover, detectors in the detector group 50 monitor the conditions inside the printer 1. The detectors output detection results to the printer-side controller 60. The printer-side controller 60 that has received the detection results from the detectors controls sections that are to be controlled, based on the detection results.

Regarding the Paper Transporting Mechanism 20

The paper transporting mechanism 20 corresponds to a medium transporting section for transporting a medium. The paper transporting mechanism 20 sends the paper S serving as a medium to a printable position, as well as transports the paper S by a predetermined transport amount in a transport direction. The transport direction is a direction that intersects a carriage movement direction described next. As shown in FIG. 3, the paper transporting mechanism 20 has a transport motor 21 and a transport roller 22, for example. The transport motor 21 serves as a driving source of the transport roller 22. The operation of the transport motor 21 is controlled by the printer-side controller 60.

Regarding the Carriage Moving Mechanism 30

The carriage moving mechanism 30 is for moving a carriage CR to which the head unit 40 is attached in the carriage movement direction. The carriage movement direction includes a movement direction from one side to the other side and a movement direction from the other side to the one side. Herein, since the head unit 40 has the head 41, the carriage movement direction corresponds to a head movement direction in which the head 41 moves. Furthermore, the carriage moving mechanism 30 corresponds to a head moving section for moving the head 41 in a predetermined direction.

The carriage moving mechanism 30 has a carriage motor 31, a guide shaft 32, a timing belt 33, a drive pulley 34, and an idler pulley 35. The carriage motor 31 corresponds to a driving source when moving the carriage CR. The operation of the carriage motor 31 is controlled by the printer-side controller 60. The drive pulley 34 is attached to a rotation shaft of the carriage motor 31. The drive pulley 34 is disposed on one end side of the carriage movement direction. The idler pulley 35 is disposed on the other end side of the carriage movement direction, which is opposite to the side of the drive pulley 34. The timing belt 33 is connected to the carriage CR and also extended between the drive pulley 34 and the idler pulley 35. The guide shaft 32 supports the carriage CR such that the carriage CR can move. The guide shaft 32 is attached along the carriage movement direction. Thus, when the carriage motor 31 operates, the carriage CR moves in the carriage movement direction along the guide shaft 32.

Regarding the Head Unit 40

The head unit 40 has the head 41 for ejecting ink toward the paper S. The head unit 40 is attached to the carriage CR. The head 41 of the head unit 40 is provided on the lower face of a head case (not shown). Moreover, the head controller HC of the head unit 40 is provided inside the head case. The head controller HC is described later.

Regarding the Head 41

Figure 4A:
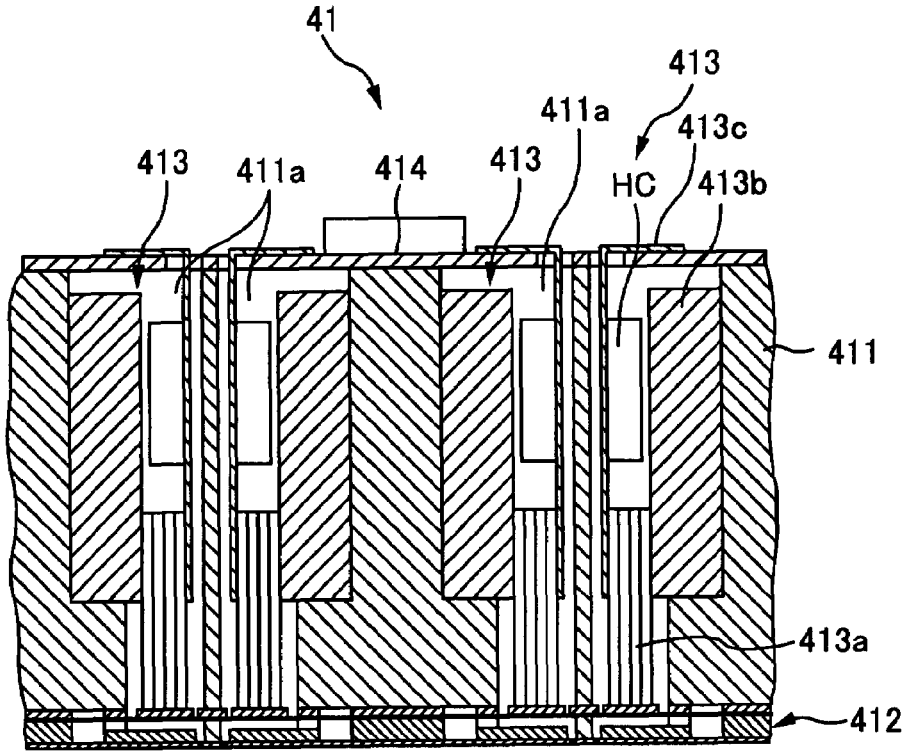
FIG. 4A is a cross-sectional view of a head.
Figure 4B:
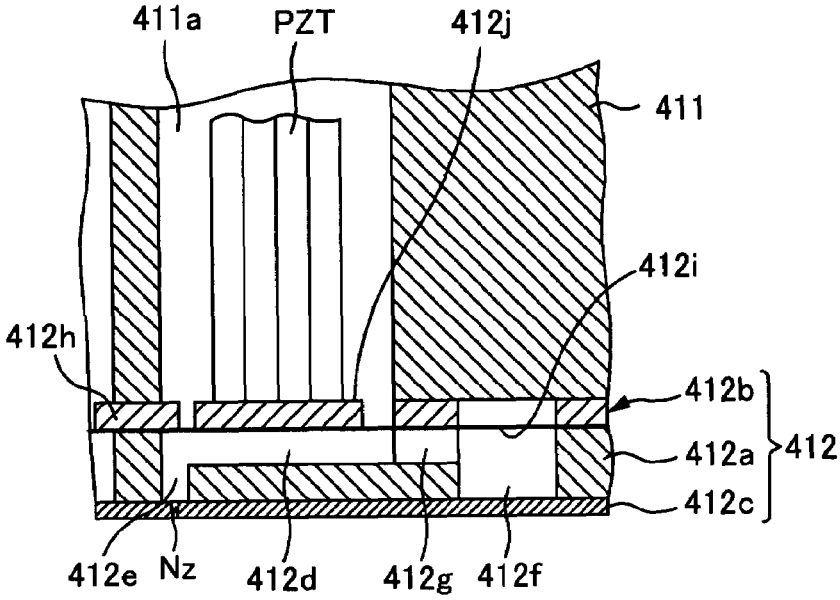
FIG. 4B is an enlarged view illustrating the main portions of the head.

FIG. 4A is a cross-sectional view of the head 41. FIG. 4B is an enlarged view illustrating the main portions of the head 41. The head 41 is a type of a liquid ejection head for ejecting ink, which is a type of liquid. As shown in FIG. 4A, the head has a case 411, a flow path unit 412, piezo element units 413, and an intermediate board 414. The case 411 is a block-shaped member in which containment chambers 411*a* for containing the piezo element units 413 are formed. The piezo element units 413 are attached to the respective nozzle rows, for example.

As shown in FIG. 4B, the flow path unit 412 has a flow path-forming plate 412*a*, an elastic plate 412*b* joined to one surface of the flow path-forming plate 412*a*, and a nozzle plate 412*c* joined to the other surface of the flow path-forming plate 412*a*. The flow path-forming plate 412*a* is made of a material such as silicon wafer or metal plate. A groove portion serving as a pressure chamber 412*d*, a through-hole serving as a nozzle communication opening 412*e*, a through-hole serving as a common ink chamber 412*f*, and a groove portion serving as an ink supply path 412*g* are formed on the flow path-forming plate 412*a*. The elastic plate 412*b* has a support frame 412*h*, and an island section 412*j* joined to an end of a piezo element PZT. An elastic region is formed by an elastic film 412*i* around the island section 412*j*.

The piezo element unit 413 is constituted by a piezo element group 413*a*, a bonding board 413*b*, and an element wiring board 413*c*. The piezo element group 413*a* is in the shape of comb teeth, and each comb tooth-shaped portion corresponds to the piezo element PZT. The piezo element group 413*a* has the piezo elements PZT in a number corresponding to nozzles Nz. Furthermore, the bonding board 413*b* is a rectangular plate with one surface bonded to the piezo element group 413*a* and the other surface bonded to the case 411.

The intermediate board 414 is a wiring board for electrically connecting the head controller HC, the piezo elements PZT, the drive signal generating circuit 70, and the printer-side controller 60. The intermediate board 414 is connected to the element wiring board 413*c*. The intermediate board 414 is electrically connected also to a flexible cable FC shown in FIG. 3. The flexible cable FC is for sending drive signals COM from the drive signal generating circuit 70 and head control signals from the printer-side controller 60. Wirings provided on the intermediate board 414 include a wiring for the ground.

The piezo element PZT is deformed by making potential different between opposing electrodes. In this example, the piezo element PZT is extended and contracted in the longitudinal direction of the element. The extension/contraction amount is determined in correspondence with the potential of the piezo element PZT. The potential of the piezo element PZT is determined based on an applied portion (waveform sections SS11 to SS23 described later, see FIG. 12) of the drive signals COM. Thus, the piezo element PZT is extended and contracted in accordance with the potential given by the applied drive signals COM. When the piezo element PZT is extended or contracted, the island section 412*j* is pushed toward the pressure chamber 412*d* or pulled in the opposite direction. More specifically, the head 41 can be said to cause the operation of the piezo element PZT, thereby changing the volume of the pressure chamber 412*d* that is in communication with the nozzle Nz. At this time, the elastic film 412*i* around the island section is deformed, and thus ink can be efficiently ejected from the nozzle Nz. The piezo element PZT corresponds to an element that is charged and discharged by the drive signals COM and that performs an operation for causing ink to be ejected.

Figure 12:
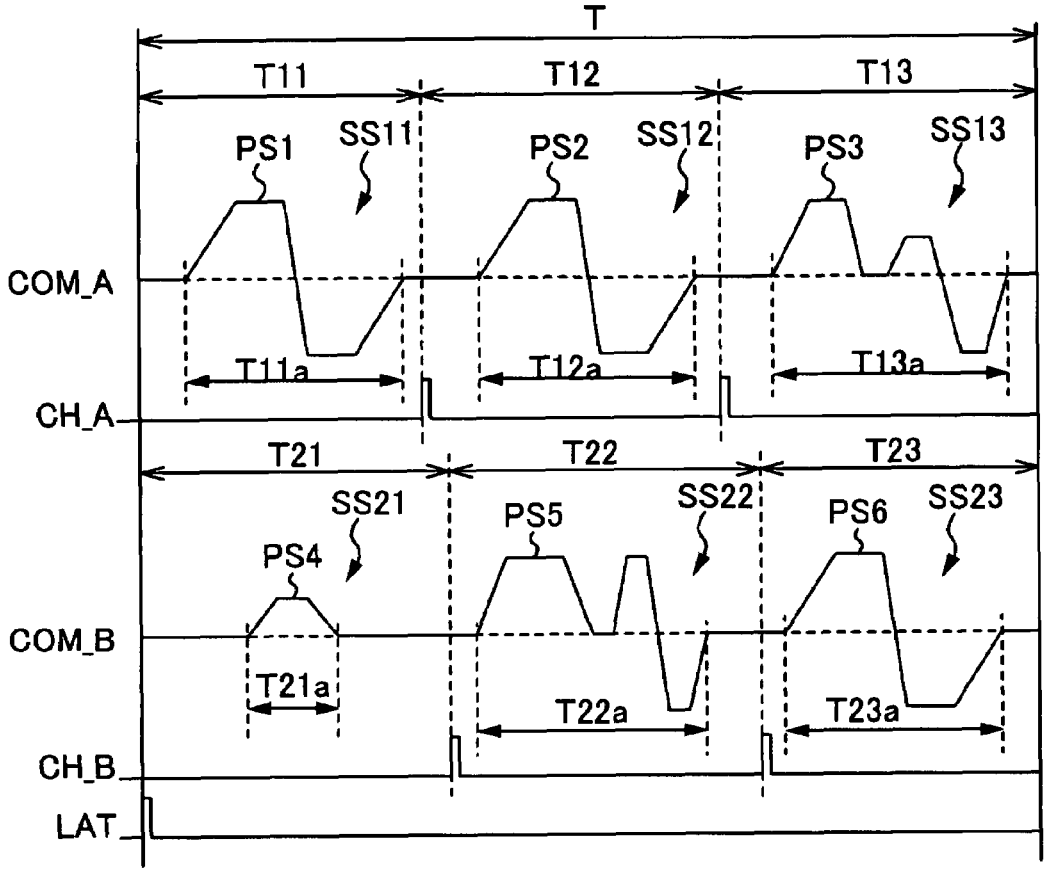
FIG. 12 is a diagram showing a first drive signal, a second drive signal, a latch signal, a first change signal, and a second change signal that are generated in a dot forming operation.

When the piezo elements PZT are used in the head 41, the amount or speed of ink that is to be ejected can be variously controlled based on the waveform of an applied drive pulse (for example, a first drive pulse PS1 to a sixth drive pulse PS6, see FIG. 12). Furthermore, it is also possible to prevent the viscosity of ink from increasing, by slightly vibrating the meniscus (the free surface of ink exposed at the nozzle Nz) without causing ejection of the ink.

Regarding the Detector Group 50

The detector group 50 is for monitoring the conditions inside the printer 1. The detector group includes, for example, a linear encoder 51 shown in FIG. 3. The linear encoder 51 is for detecting the position of the carriage CR (the head 41) in the carriage movement direction. The linear encoder 51 outputs an encoder signal that rises to the H level every time the carriage CR moves a distance corresponding to 180 dpi (25.4/180 mm), for example. In addition to this, the detector group includes a rotary encoder (not shown) for detecting the rotation amount of the transport roller 22 and a paper detector (not shown) for detecting whether or not the paper S is present.

Regarding the Printer-Side Controller 60

The printer-side controller 60 is for controlling the printer 1. As shown in FIG. 2, the printer-side controller 60 has an interface section 61, a CPU 62, a memory 63, and a control unit 64. The interface section 61 exchanges data with the computer 110, which is an external apparatus. The CPU 62 is a computing processing unit for performing the overall control of the printer 1. The memory 63 is for reserving an area for storing programs for the CPU 62 and a working area, for example, and is constituted by a storage element such as a RAM, an EEPROM, or a ROM. The CPU 62 controls the sections that are to be controlled, following the computer programs stored in the memory 63. For example, the CPU 62 controls the paper transporting mechanism 20 and the carriage moving mechanism 30 via the control unit 64.

The CPU 62 generates a signal for prescribing a latch timing, based on the encoder signal that is output from the linear encoder 51. For example, if the print resolution is 720 dpi, then a signal for prescribing a latch timing is generated by multiplying the encoder signal by four. The CPU 62 outputs a latch pulse at a timing prescribed by this signal. More specifically, at this timing, a latch signal LAT is switched to the H level. The latch pulse has a voltage that is a logic voltage (3.3 V, 5 V, for example) and has a rectangular waveform with a generation period of approximately 500 ns, for example.

Furthermore, the CPU 62 outputs, to the head controller HC, head control signals for controlling the operation of the head 41 and outputs, to the drive signal generating circuit 70, control signals for causing generation of drive signals COM (a first drive signal COM_A and a second drive signal COM_B, see FIG. 12). As shown in FIG. 9 for example, the head control signals are a clock CLK, dot forming data SI, a latch signal LAT, a first change signal CH_A, and a second change signal CH_B. The latch signal LAT has the latch pulse, and the first change signal CH_A and the second change signal CH_B have the change pulses. The latch pulse and the change pulses correspond to timing pulses for prescribing timings at which the drive signals COM are applied to the piezo elements PZT (described later). Thus, the printer-side controller 60 corresponds to a timing pulse generating section.

When the printer-side controller 60 uses these head control signals, it is possible to cause selective application of the drive signals COM (more specifically, the waveform sections SS11 to SS13 in the first drive signal COM_A, and the waveform sections SS21 to SS23 in the second drive signal COM_B) to the piezo elements PZT, in cooperation with the head controller HC. Thus, the printer-side controller 60, the drive signal generating circuit 70, and the head controller HC constitute a device for controlling the head 41.

Regarding Generation Data of DAC Values and Timing Signals

The control signals for causing generation of the drive signals COM are, for example, DAC values. The DAC values are data (voltage information) for determining the voltage of the drive signals COM that are output from a first drive signal generating section 70A and a second drive signal generating section 70B (see FIG. 6) of the drive signal generating circuit 70. The contents of the control signals are updated every update cycle that is extremely short. For example, the contents are updated every update cycle prescribed by a 24 MHz clock. The waveforms of the first drive signal COM_A and the second drive signal COM_B are determined by the DAC values. Thus, the DAC values correspond to waveform generating information. As the DAC values in this embodiment, a first DAC value as waveform generating information for the first drive signal COM_A and a second DAC value as waveform generating information for the second drive signal are determined.

Figure 5:
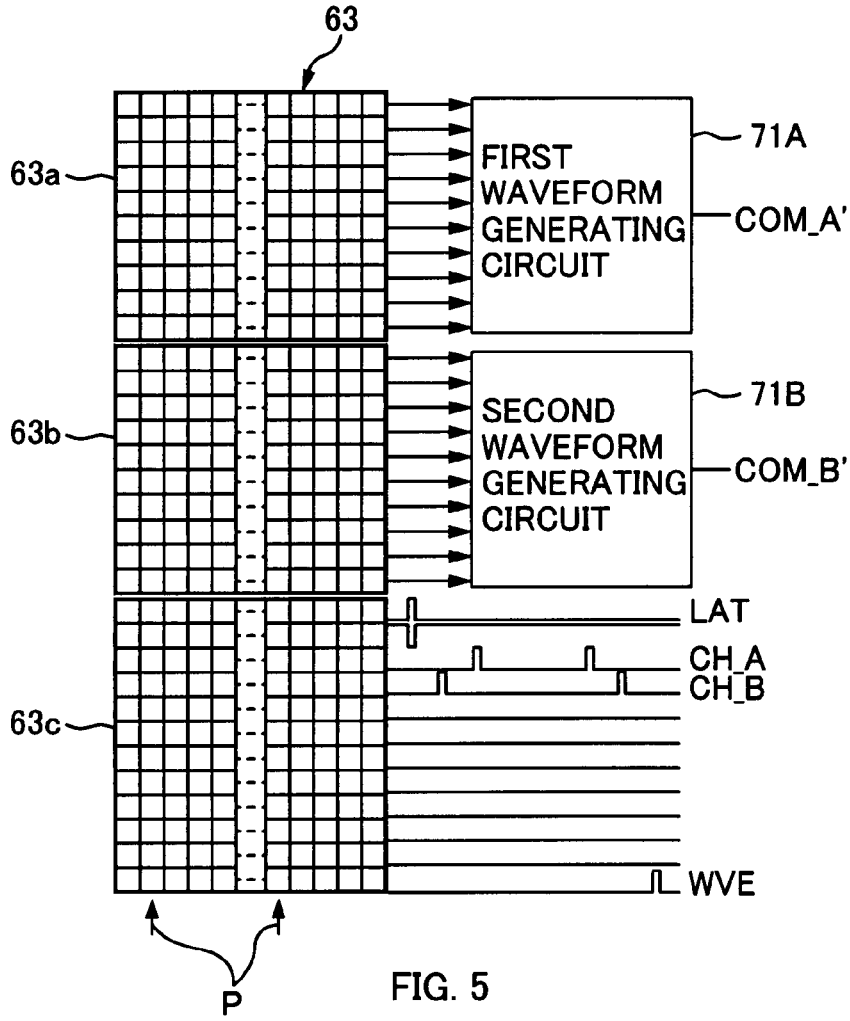
FIG. 5 is a conceptual diagram for illustrating output of DAC values and output of head control signals.

FIG. 5 is a conceptual diagram for illustrating output of the DAC values and output of the head control signals. A part of the area of the memory 63 in the printer-side controller 60 is used as a voltage data memory for drive signals, and stores the first DAC values and the second DAC values. In the example shown in FIG. 5, the memory 63 has a first DAC value storing section 63*a* for storing the first DAC value every update cycle and a second DAC value storing section 63*b* for storing the second DAC value every update cycle, and functions as a voltage data memory for the drive signals. Each of the storing sections 63*a* and 63*b* has a plurality of sets of 10-bit registers, the number of the sets corresponding to the number of update cycles. In the example shown in FIG. 5, one rectangle indicates one register, and ten registers aligned in the vertical direction indicate the first DAC value (the first DAC value storing section 63*a*) in 10 bits and the second DAC value (the second DAC value storing section 63*b*) in 10 bits at a particular update cycle. The first DAC value and the second DAC value are specified by, for example, a pointer P that moves every update cycle. The first DAC value and the second DAC value that are stored in the specified area (address) are output respectively to a first waveform generating circuit 71A and a second waveform generating circuit 71B.

Furthermore, another part of the area of the memory 63 is used as a generation data memory 63*c* for timing pulses, and stores generation data relating to the latch signal LAT, the first change signal CH_A and the second change signal CH_B. In addition to this, generation data of an end timing signal WVE that has an end pulse for prescribing a generation end timing of the drive signals COM is also stored. In this example, the generation data memory 63*c* for timing pulses has 12 registers at one update cycle. A plurality of sets of the 12 registers are provided, the number of the sets corresponding to the number of update cycles. Thus, 12 types of signals can be generated in a parallel manner. When the signals are generated, data stored in the area (address) specified by the pointer P is read out, as in the case of data stored in the voltage data memory (storing sections 63*a* and 63*b*) for drive signals. Herein, if the data stored in the register is "0", then the signal is at the L level. If the data stored is "1", then the signal is at the H level. Then, pulses are generated throughout a period in which the data is "1". Thus, the data stored in the registers corresponds to voltage information of the signals. Furthermore, the generation data of the signals stored in the generation data memory for timing pulses is stored at the same update cycle as the first DAC value and the second DAC value.

In this manner, in the printer 1, the first DAC value, the second DAC value, and generation data for the timing pulses (the latch pulse, the first change pulse, and the second change pulse) are stored in the common memory 63 at the same update cycle. It is possible to easily generate drive signals COM and timing pulses that are repeatedly generated every printing period, because the printer-side controller 60 generates the signals by reading out data at a timing prescribed by the update cycle. Furthermore, it is possible to easily synchronize the drive signals COM and the timing pulses.

Furthermore, in this embodiment, the clock for prescribing the update cycle is 24 MHz, and thus the first DAC value and the second DAC value are read out every 0.04 μs approximately. One printing period T is, for example, approximately 140 μs. Thus, even when making an allowance for the margin, approximately 200 μs of the printing period T can be said to be sufficient. Accordingly, the total volume of the voltage data memory (the storing sections 63*a* and 63*b*) for drive signals and the generation data memory 63*c* for timing pulses is determined taking these conditions into consideration.

Regarding the Drive Signal Generating Circuit 70

Figure 6:
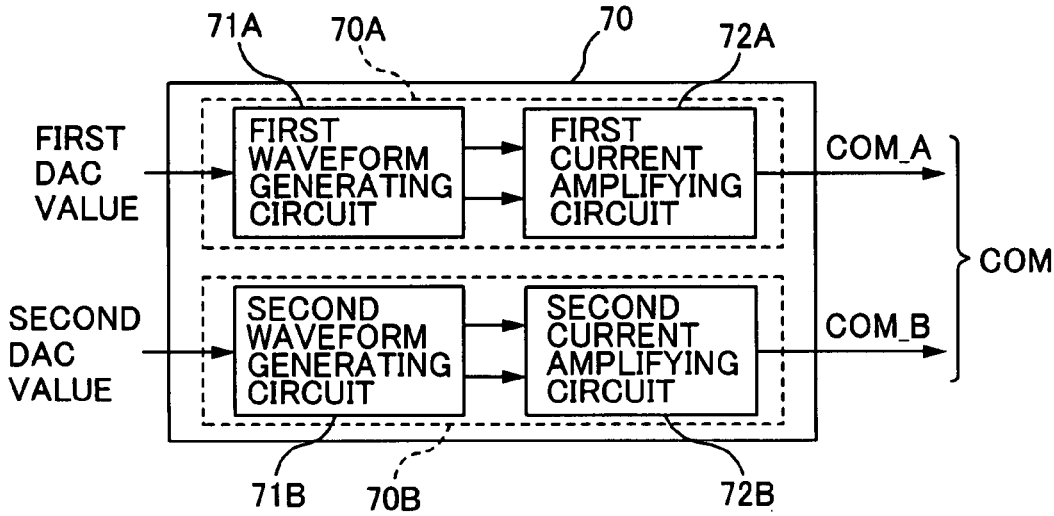
FIG. 6 is a block diagram for illustrating the configuration of a drive signal generating circuit.
Figure 7:
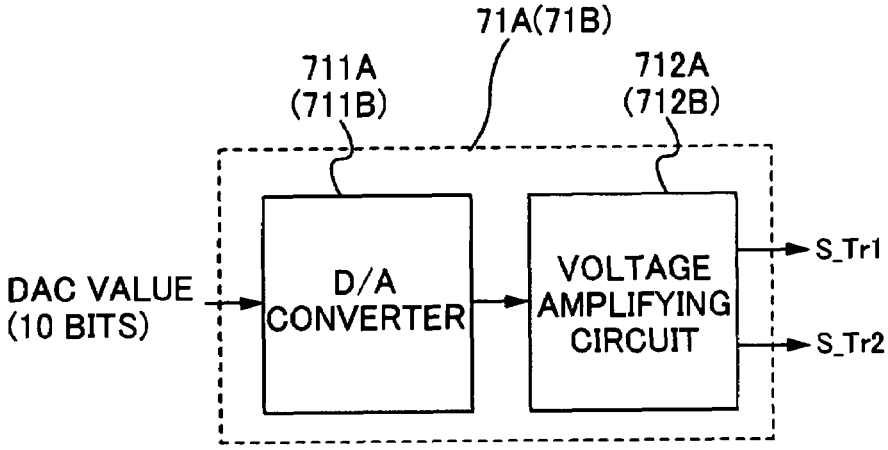
FIG. 7 is a diagram for illustrating the configuration of a first waveform generating circuit and a second waveform generating circuit in the drive signal generating circuit.
Figure 8:
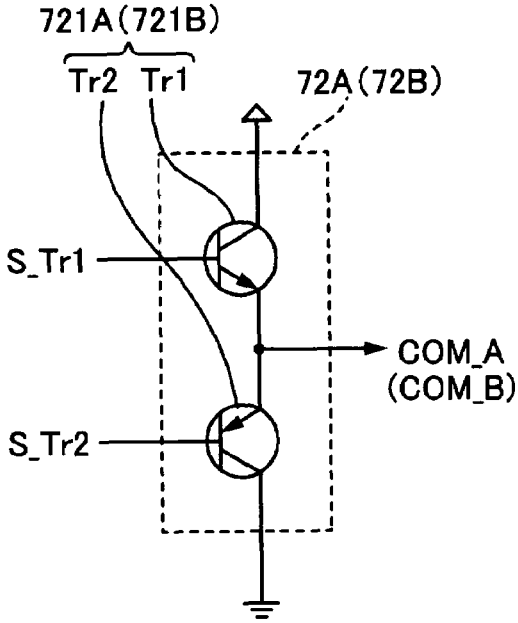
FIG. 8 is a diagram for illustrating the configuration of a first current amplifying circuit and a second current amplifying circuit.

FIG. 6 is a block diagram for illustrating the configuration of the drive signal generating circuit 70. FIG. 7 is a diagram for illustrating the configuration of the first waveform generating circuit 71A and the second waveform generating circuit 71B in the drive signal generating circuit 70. FIG. 8 is a diagram for illustrating the configuration of a first current amplifying circuit 72A and a second current amplifying circuit 72B. It should be noted that in FIGS. 7 and 8, the configurations of the second waveform generating circuit 71B and the second current amplifying circuit 72B are indicated by the symbols in parentheses.

The drive signal generating circuit 70 is for generating drive signals COM that are used in common by the piezo elements PZT, and corresponds to a drive signal generating section. The drive signal generating circuit 70 simultaneously generates a plurality of types of drive signals COM throughout a particular period. In this embodiment, the first drive signal COM_A and the second drive signal COM_B are simultaneously generated throughout the printing period T. Thus, the drive signal generating circuit 70 has the first drive signal generating section 70A for generating the first drive signal COM_A and the second drive signal generating section 70B for generating the second drive signal COM_B. Hereinafter, the first drive signal generating section 70A and the second drive signal generating section 70B are described.

The first drive signal generating section 70A has the first waveform generating circuit 71A for generating a signal having a voltage that corresponds to the first DAC value (first waveform generating information), and the first current amplifying circuit 72A for amplifying the current of the signal that has been generated by the first waveform generating circuit 71A. The second drive signal generating section 70B has the second waveform generating circuit 71B for generating a signal having a voltage that corresponds to the second DAC value (second waveform generating information), and the second current amplifying circuit 72B for amplifying the current of the signal that has been generated by the second waveform generating circuit 71B. Herein, the first waveform generating circuit 71A generates a signal with a desired waveform based on the first DAC value. The second waveform generating circuit 71B generates a signal with another desired waveform based on the second DAC value. Furthermore, the first current amplifying circuit 72A amplifies the current of the signal with the desired waveform, and outputs the signal as the first drive signal COM_A. The second current amplifying circuit 72B amplifies the current of the signal with another desired waveform, and outputs the signal as the second drive signal COM_B. It should be noted that the first waveform generating circuit 71A and the second waveform generating circuit 71B have the same configuration, and that the first current amplifying circuit 72A and the second current amplifying circuit 72B have the same configuration. Thus, in the following description, the first drive signal generating section 70A, that is, the first waveform generating circuit 71A and the first current amplifying circuit 72A are mainly described.

Regarding the First Waveform Generating Circuit 71A

As shown in FIG. 7, the first waveform generating circuit 71A has a digital-analog converter (D/A converter) 711A and a voltage amplifying circuit 712A. The digital-analog converter 711A is an electric circuit for outputting a voltage signal that corresponds to the first DAC value. The first DAC value is information for specifying the voltage (hereinafter, also referred to as an "output voltage") that is to be output from the voltage amplifying circuit 712A, and is read out from the memory 63 to be output by the CPU 62, as described above. In this embodiment, the first DAC value is constituted by 10 bits of data.

The voltage amplifying circuit 712A amplifies the output voltage from the digital-analog converter 711A up to a voltage that is suitable for operating the piezo elements PZT. With the voltage amplifying circuit 712A of this embodiment, the output voltage from the digital-analog converter 711A is amplified to a maximum of 40V to 49V. The output voltage after amplification is output to the first current amplifying circuit 72A as a control signal S_Tr1 and a control signal S_Tr2. The control signal S_Tr1 and the control signal S_Tr2 are drive signals COM_A' before the current is amplified, and correspond to signals with a desired waveform. It should be noted that the control signal S_Tr1 and the control signal S_Tr2 have the same waveform.

Regarding the First Current Amplifying Circuit 72A

The first current amplifying circuit 72A is a circuit for supplying sufficient current such that a plurality of piezo elements PZT can operate without any problem. The first current amplifying circuit 72A shown in FIG. 8 is constituted by a first transistor pair 721A that operates in accordance with a change in the voltage of the first drive signal COM_A. The first transistor pair 721A is constituted by two transistors that are complementarily connected to each other. More specifically, the first transistor pair 721A is constituted by an NPN transistor Tr1 and a PNP transistor Tr2 whose emitter terminals are connected to each other. The NPN transistor Tr1 is a transistor that operates when the voltage of the drive signal COM is rising. A collector and an emitter of the NPN transistor Tr1 are respectively connected to a power source and an output signal line for the first drive signal COM_A. The PNP transistor Tr2 is a transistor that operates when the voltage of the drive signal COM is falling. A collector and an emitter of the PNP transistor Tr2 are respectively connected to the ground and the output signal line for the first drive signal COM_A. The operation of the first current amplifying circuit 72A, that is, the first transistor pair 721A is controlled by the signals COM_A' (the control signal S_Tr1 and the control signal S_Tr2) that are output from the first waveform generating circuit 71A. Accordingly, the first drive signals COM_A that are output from the first current amplifying circuit 72A are signals with a waveform tracing the desired waveform.

Regarding the Second Drive Signal Generating Section 70B

Next, the second drive signal generating section 70B is briefly described. As described above, the configuration of the second waveform generating circuit 71B is the same as that of the first waveform generating circuit 71A, and the configuration of the second current amplifying circuit 72B is the same as that of the first current amplifying circuit 72A. More specifically, the second waveform generating circuit 71B has a digital-analog converter 711B and a voltage amplifying circuit 712B. Moreover, the second current amplifying circuit 72B has a second transistor pair 721B that generates heat in accordance with a change in the voltage of the second drive signal COM_B. The second transistor pair 721B has an NPN transistor Tr1 and a PNP transistor Tr2 whose emitter terminals are connected to each other. More specifically, the second transistor pair 721B is also constituted by a pair of transistors that are complementarily connected to each other.

Regarding the Outline of the Drive Signals COM that are Generated

Herein, the outline of the first drive signal COM_A and the second drive signal COM_B that are generated by the drive signal generating circuit 70 is described. In this description, reference is made to FIG. 12. The first drive signal COM_A and the second drive signal COM_B are repeatedly generated taking the printing period T as the repeating unit. Accordingly, the printing period T corresponds to the particular period for simultaneously generating the first drive signal COM_A and the second drive signal COM_B.

The first drive signal COM_A has a waveform section SS11 that is generated in a period T11, a waveform section SS12 that is generated in a period T12, and a waveform section SS13 that is generated in a period T13. The waveform sections SS11 to SS13 constitute first waveform sections contained in the first drive signal COM_A. The waveform sections SS11 to SS13 have drive pulses for causing the piezo elements PZT to perform predetermined operations. More specifically, the waveform section SS11 has a first drive pulse PS1, and the waveform section SS12 has a second drive pulse PS2. The waveform section SS13 has a third drive pulse PS3. The second drive signal COM_B has a waveform section SS21 that is generated in a period T21, a waveform section SS22 that is generated in a period T22, and a waveform section SS23 that is generated in a period T23. The waveform sections SS21 to SS23 constitute second waveform sections contained in the second drive signal COM_B. The waveform sections SS21 to SS23 also have drive pulses for causing the piezo elements PZT to perform predetermined operations. More specifically, the waveform section SS21 has a fourth drive pulse PS4, and the waveform section SS22 has a fifth drive pulse PS5. The waveform section SS23 has a sixth drive pulse PS6.

Herein, the fourth drive pulse PS4 is a slight vibration pulse for displacing the meniscus to the extent that ink is not ejected. The drive pulses other than the fourth drive pulse PS4 correspond to ejection pulses for causing the piezo elements PZT to perform an ejecting operation for ejecting ink. The drive signals COM_A and COM_B are described later in detail.

Regarding the Head Controller HC

Next, the head controller HC is described. FIG. 9 is a diagram for illustrating the configuration of the head controller HC. The head controller HC is for controlling ejection of ink using six types of dot forming data SI. More specifically, the head controller HC corresponds to a signal applying section, and selectively applies the waveform sections SS11 to SS13 in the first drive signal COM_A at a timing prescribed by the latch pulse or the first change pulse (corresponding to a first timing pulse) and selectively applies the waveform sections SS21 to SS23 in the second drive signal COM_B at a timing prescribed by the latch pulse or the second change pulse (corresponding to a second timing pulse). More specifically, the head controller HC applies either the waveform sections (the waveform sections SS11 to SS13) in the first drive signal COM_A or the waveform sections (the waveform sections SS21 to SS23) in the second drive signal COM_B to the piezo elements PZT, at a timing prescribed by either the first timing pulses or the second timing pulses. Thus, the piezo elements PZT operate to eject ink or to slightly vibrate the meniscus.

As shown in FIG. 9, the head controller HC has first shift registers 81A, second shift registers 81B, third shift registers 81C, first latch circuits 82A, second latch circuits 82B, third latch circuits 82C, a control logic 83, decoders 84, first switches 85A, and second switches 85B. In the head controller HC, the sections excluding the control logic 83, that is, the shift registers 81, the latch circuits 82, the decoder 84, the first switch 85A, and the second switch 85B are provided for each of the piezo elements PZT.

The dot forming data SI from the printer-side controller 60 is set in the first shift register 81A, the second shift register 81B, and the third shift register 81C. More specifically, the middle-order bit of the dot forming data SI is set in the first shift register 81A. The lower-order bit of the dot forming data SI is set in the second shift register 81B. The higher-order bit of the dot forming data SI is set in the third shift register 81C. Herein, the dot forming data SI that is supplied via the same signal line is set in the first shift register 81A and the second shift register 81B at a timing prescribed by a clock CLK. On the other hand, the dot forming data SI that is supplied via another signal line is set in the third shift register 81C at a timing prescribed by the clock CLK.

The first latch circuit 82A, the second latch circuit 82B, and the third latch circuit 82C are for latching the dot forming data SI that is set in the first shift register 81A, the second shift register 81B, and the third shift register 81C. More specifically, the first latch circuit 82A latches the dot forming data SI that is set in the first shift register 81A. The second latch circuit 82B latches the dot forming data SI that is set in the second shift register 81B. The third latch circuit 82C latches the dot forming data SI that is set in the third shift register 81C. Since the dot forming data SI is latched by the first latch circuit 82A to the third latch circuit 82C, the dot forming data SI is put into a group for each nozzle Nz, and input to the decoder 84.

The control logic 83 stores switch operation information for determining the operation of the first switch 85A and switch operation information for determining the operation of the second switch 85B. These sets of switch operation information are determined for each tone. In this embodiment, the dot forming data SI indicates six tones, and thus six types of switch operation information q0 to q5 are used for the first switch 85A, and six types of switch operation information q6 to q11 are used for the second switch 85B.

The switch operation information q0 to q11 is specifically described below. More specifically, the switch operation information q0 to q5 for the first switch 85A includes the switch operation information q0 corresponding to non-formation of a dot (the dot forming data SI [000]), the switch operation information q1 corresponding to formation of a first small dot (the dot forming data SI [001]), the switch operation information q2 corresponding to formation of a second small dot (the dot forming data SI [100]), the switch operation information q3 corresponding to formation of a first medium dot (the dot forming data SI [010]), the switch operation information q4 corresponding to formation of a second medium dot (the dot forming data SI [101]), and the switch operation information q5 corresponding to formation of a large dot (the dot forming data SI [011]). Furthermore, the switch operation information q6 to q11 for the second switch 85B includes the switch operation information q6 corresponding to non-formation of a dot, the switch operation information q7 corresponding to formation of a first small dot, the switch operation information q8 corresponding to formation of a second small dot, the switch operation information q9 corresponding to formation of a first medium dot, the switch operation information q10 corresponding to formation of a second medium dot, and the switch operation information q11 corresponding to formation of a large dot.

Figure 10:
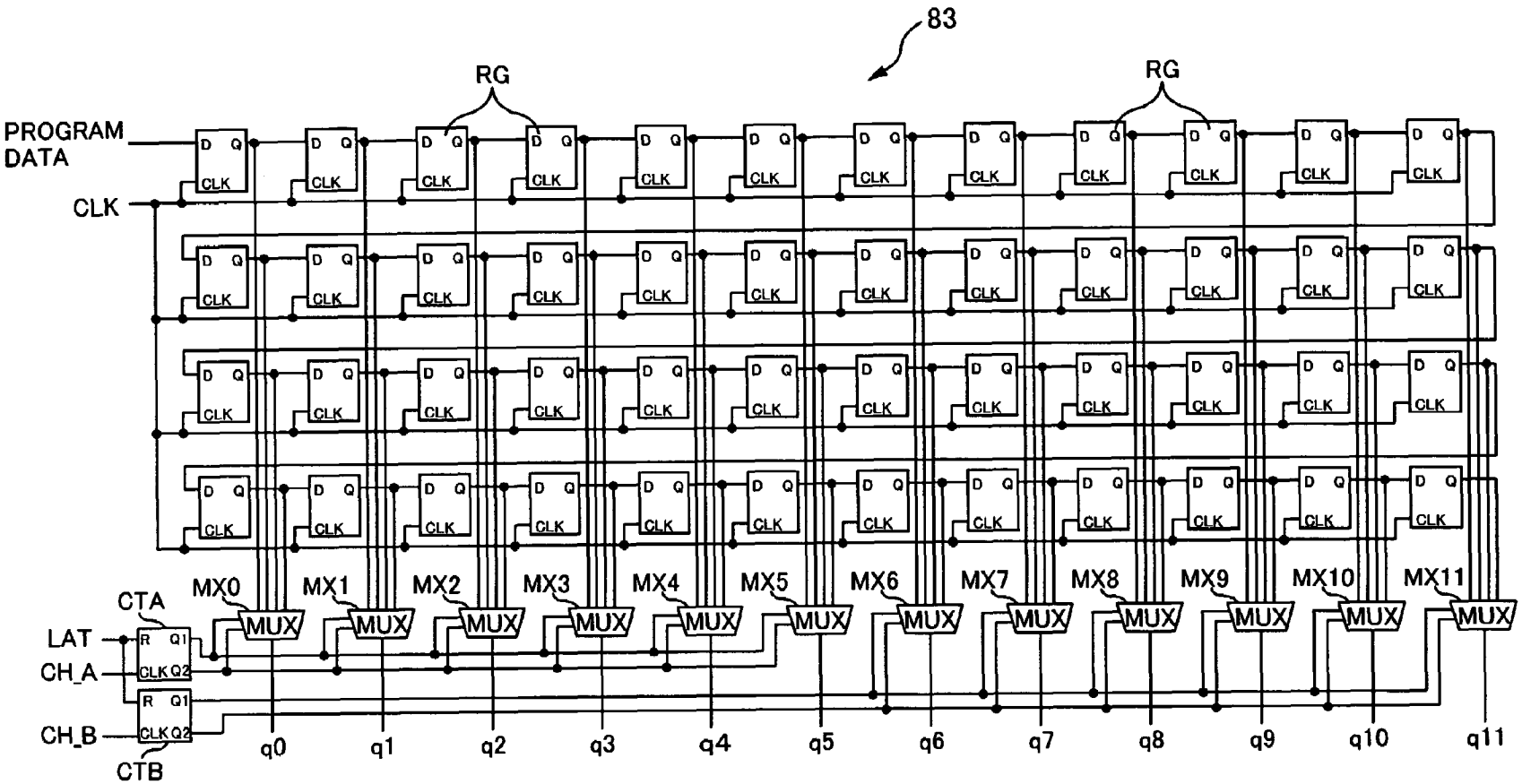
FIG. 10 is a diagram for illustrating the configuration of a control logic.

The switch operation information q0 to q11 is output from the control logic 83. The contents of the switch operation information q0 to q11 are updated at a timing prescribed by a latch pulse of the latch signal LAT, a timing prescribed by a first change pulse of the first change signal CH_A, and a timing prescribed by a second change pulse of the second change signal CH_B. FIG. 10 is a diagram for illustrating the configuration of the control logic 83. As shown in FIG. 10, the control logic 83 has a plurality of registers RG each capable of storing one bit of data. Each register RG is constituted by, for example, a D-FF (delay flip flop) circuit. Each register RG stores data constituting each bit of the switch operation information q0 to q11. The switch operation information q0 to q11 is sent from the printer-side controller 60, as in the case of the dot forming data SI.

For the sake of convenience, in FIG. 10, the registers RG are arranged in a matrix of four registers in the column direction (vertical direction) and 12 registers in the row direction (horizontal direction). The four registers RG in the same column are put into a group, and the registers RG in the same group are connected to the same multiplexer (MX0 to MX11). In this example, 12 groups are formed.

These groups respectively correspond to the switch operation information q0 to q11. For example, the registers RG that are connected to the multiplexer MX0 store the respective bits of data (corresponding to selection data) constituting the switch operation information q0. The registers RG that are connected to the multiplexer MX5 store the respective bits of data constituting the switch operation information q5. The registers RG that are connected to the multiplexer MX11 store the respective bits of data constituting the switch operation information q11.

In the groups of the registers RG, the registers RG that are arranged in the uppermost row in the drawing store data used in a first period of the printing cycle T. More specifically, the registers RG that are arranged in the uppermost row in the groups connected to the multiplexers MX0 to MX5 store data used in the period T11. The registers RG that are arranged in the uppermost row in the groups connected to the multiplexers MX6 to MX11 store data used in the period T21. The registers RG that are arranged in the second row from the top store data used in a second period of the printing cycle. More specifically, the registers store data used in the period T12 or the period T22. Similarly, the registers RG that are arranged in the third row from the top store data used in a third period (the period T13 or the period T23) of the printing cycle. Accordingly, the control logic 83 can store data for a maximum of the fourth period.

To summarize the above, the registers RG in the control logic 83 can be said to store the switch operation information q0 to q11 determined by factors such as the type of the corresponding drive signal COM (the first drive signal COM_A or the second drive signal COM_B), the corresponding the dot forming data SI (data [000] to data [011]), and the corresponding waveform section (the waveform sections SS11 to SS23). Since the switch operation information q0 to q11 is selection data for selecting the waveform sections SS11 to SS23, the registers RG correspond to selection data storing sections.

The multiplexers MX0 to MX11 output data stored in the registers RG. At that time, the data that is output is updated at a timing prescribed by the latch pulse or the change pulse. For example, the multiplexers MX0 to MX5 switch registers based on a count value output from a first counter CTA. The first counter CTA is reset at the rising of the latch pulse, and its count is increased at the rising of the first change pulse in the first change signal CH_A. Thus, when the latch pulse is input, data for the period T11 is output as the switch operation information q0 to q5 from the multiplexers MX0 to MX5.

Furthermore, when a first change pulse at the first order is input, data for the period T12 is output from the multiplexer MX0 to MX5. When a first change pulse at the second order is input, data for the period T13 is output from the multiplexer MX0 to MX5. Similarly, the multiplexers MX6 to MX11 switch registers based on a count value output from a second counter CTB. The second counter CTB is reset at the rising of the latch pulse, and its count is increased at the rising of the second change pulse in the second change signal CH_B. Thus, when the latch pulse is input, data for the period T21 is output as the switch operation information q6 to q11 from the multiplexers MX6 to MX11. Furthermore, when a second change pulse at the first order is input, data for the period T22 is output from the multiplexers MX6 to MX11. When a second change pulse at the second order is input, data for the period T23 is output from the multiplexers MX6 to MX11.

As shown in the description above, the control logic 83 corresponds to a first data updating section for updating first selection data (the switch operation information q0 to q5) for selecting the first waveform sections (the waveform sections SS11 to SS13) in the first drive signal COM_A, at a timing prescribed by the first timing pulse (the latch pulse, the first change pulse). Furthermore, the control logic 83 also corresponds to a second data updating section for updating second selection data (the switch operation information q6 to q11) for selecting the second waveform sections (the waveform sections SS21 to SS23) in the second drive signal COM_B, at a timing prescribed by the second timing pulse (the latch pulse, the second change pulse). The specific contents of the selection data q0 to q11 are described later.

The decoder 84 selects the switch operation information q0 to q11 that is output from the control logic 83, according to the dot forming data SI latched by the latch circuits 82, and outputs the selected switch operation information to each of the first switch 85A and the second switch 85B. The first switch 85A is a switch that operates following the switch operation information q0 to q5, and controls application of the first drive signal COM_A to the piezo element PZT. The second switch 85B is a switch that operates following the switch operation information q6 to q11, and controls application of the second drive signal COM_B to the piezo element PZT. The switches 85A and 85B apply the corresponding drive signals COM_A and COM_B to the piezo element PZT throughout the period in which data indicates "1". In a period in which data indicates "0", the corresponding drive signals COM_A and COM_B are not applied to the piezo element PZT.

Printing Operation

Regarding the Printing Operation

Figure 11:
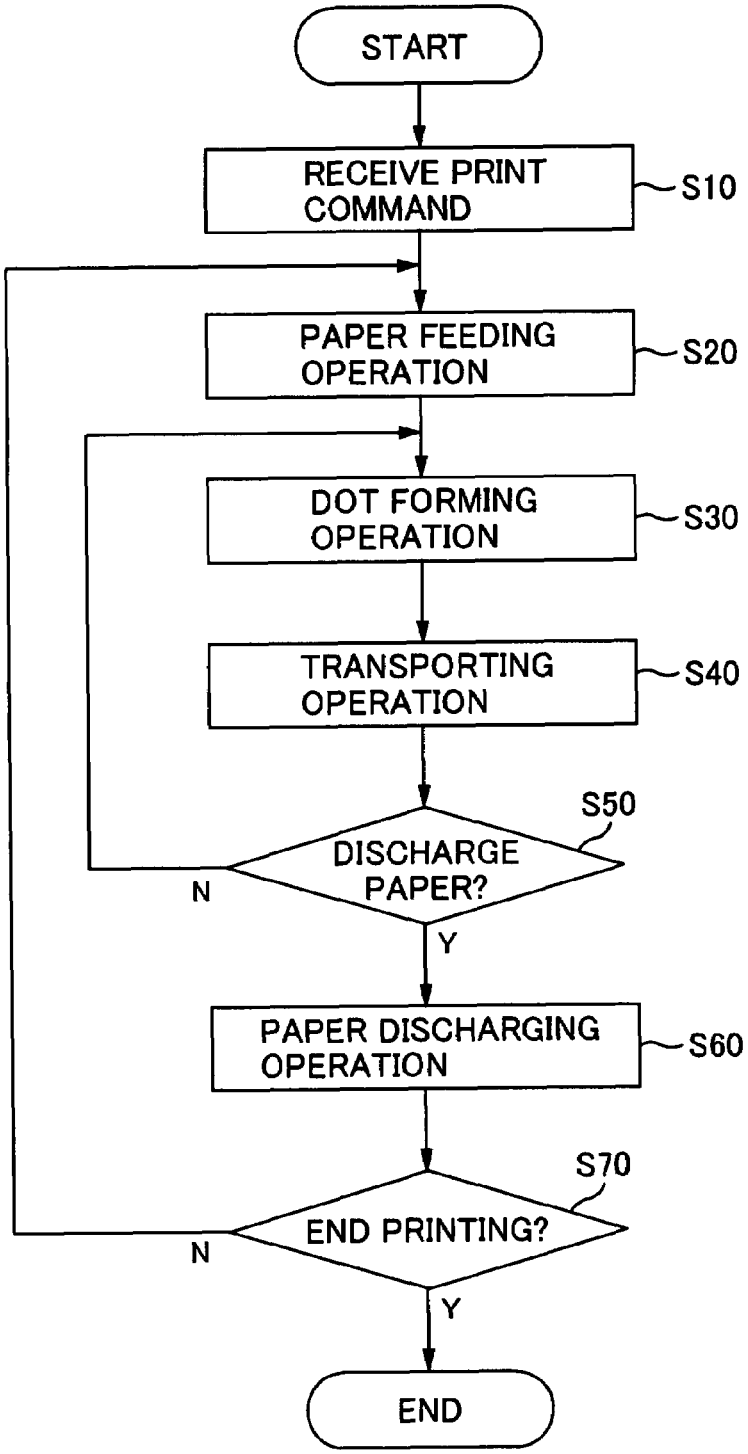
FIG. 11 is a flowchart illustrating a printing operation of the printer.

Next, a printing operation performed in the printer 1 in order to perform printing on the paper S is described. Herein, FIG. 11 is a flowchart illustrating the printing operation of the printer 1. As shown in FIG. 11, in the printer 1, a print command receiving operation (S10), a paper feeding operation (S20), a dot forming operation (S30), a transporting operation (S40), a paper discharge determination (S50), a paper discharging operation (S60), and a print end determination (S70) are performed as one iteration of a printing operation. The printing operation is performed by the CPU 62 in the printer-side controller 60. More specifically, the CPU 62 operates following computer programs stored in the memory 63, and executes these operations. Accordingly, the computer programs contain codes to execute these operations.

In the print command receiving operation, the printer-side controller 60 receives a print command from the computer 110 via the interface section 61. The print command is contained in print data that is sent from the computer 110.

The paper feeding operation is an operation to position the paper S that is to be printed at a print start position (the so-called indexing position), by moving the paper S. In the paper feeding operation, the printer-side controller 60 rotates a paper feed roller (not shown) to send the paper S that is to be printed up to the transport roller 22. Then, the printer-side controller 60 rotates the transport roller 22 to position the paper S that has been sent from the paper feed roller at the print start position.

The dot forming operation is an operation to form dots on the paper S, by causing ink to be intermittently ejected from the head 41 that moves in the carriage movement direction. The printer-side controller 60 drives the carriage motor 31 to move the carriage CR in the carriage movement direction. The printer-side controller 60 causes ink to be ejected from the head 41 (the nozzles Nz) based on the dot forming data SI, during movement of the carriage CR. Then, as described above, when ink that is ejected from the head 41 lands on the paper S, dots are formed on the paper S. The dot forming operation is described later in detail.

The transporting operation is an operation to move the paper S relative to the head 41 in the transport direction. The printer-side controller 60 rotates the transport roller 22 to transport the paper S in the transport direction. With this transporting operation, the head 41 can form dots at positions that are different from the positions of the dots formed in the previous dot forming operation.

The paper discharge determination is a process to determine whether or not to discharge the paper S that is being printed. This determination is performed based on whether or not print data is present. More specifically, the printer-side controller 60 determines whether or not print data for the paper S that is being printed is present, and if the print data remains, it is determined not to discharge the paper S. In this case, the printer-side controller 60 alternately performs the dot forming operation and the transporting operation in a repeated manner until there is no longer any remaining print data, to gradually print an image made of dots on the paper S. The printer-side controller 60 determines to discharge the paper if there is no print data, and discharges the paper S that has been printed to the outside by rotating a paper discharge roller 25. It should be noted that whether or not to discharge the paper can also be determined based on a paper discharge command contained in the print data.

The print end determination is to determine whether or not to continue printing. In this determination, the printer-side controller 60 determines whether or not print data is present. If printing is to be performed on the next paper S, then the paper feeding operation is performed on the next paper S. If printing is not to be performed on the next paper S, then the printing operation is ended.

Dot Forming Operation

Regarding the Outline of the Dot Forming Operation

In the dot forming operation, the first waveform section (SS11 to SS13) in the first drive signal COM_A is selected and a necessary waveform section is applied to the piezo elements PZT at every timing prescribed by the latch pulse or the first change pulse (more specifically, the first timing pulse). Similarly, the second waveform section (SS21 to SS23) in the second drive signal COM_A is selected and a necessary waveform section is applied to the piezo elements PZT at every timing prescribed by the latch pulse or the second change pulse (more specifically, the second timing pulse). The waveform section is selected based on the switch operation information q0 to q11 whose contents are updated at the timings of the pulses described above. The switch operation information q0 to q11 is updated using, for example, the multiplexers MX0 to MX11.

With this configuration, noise may be generated in the drive signals COM_A and COM_B at a timing for generating the timing pulses. For example, if the timing of a change pulse comes in a state where current flows toward a large number of piezo elements PZT, the current flowing up to that moment is stopped at that timing. In the relationship between the DAC value (or the control signal S_Tr1, S_Tr2) and the change pulse, a margin is provided such that current is stopped by the timing of the change pulse. However, in a case where the number of the piezo elements PZT that are to be charged or discharged is large, and the amount of the current becomes very large, wave-like distortion may be generated in the drive signals COM_A and COM_B in practice. The reason for this is that the piezo elements PZT can be regarded as capacitors. For example, in a case where the number of the piezo elements PZT that are to be charged or discharged is large, the total capacitance of the piezo elements PZT increases accordingly, and thus wave-like distortion is more likely generated. With this distortion, current may flow to the piezo elements PZT even at the timing of a change pulse.

In this manner, if the timing of a change pulse comes in a state where current flows to the piezo elements PZT, and application of the drive signals COM is suddenly stopped, then the ground potential may change in accordance with this sudden change in the current. It is possible to suppress a change in the potential if the ground can be formed sufficiently wide, but the area that can be secured as the ground is limited in a limited wiring space of the head 41. Thus, the change in the ground potential appears as noise in the drive signals COM_A and COM_B.

Furthermore, in the printer 1, the multiplexers MX0 to MX11 perform a switching operation at every timing prescribed by the timing pulses. Switching noise generated at that time also may appear in the drive signals COM_A and COM_B.

It is preferable that noise appearing in the drive signals COM_A and COM_B is as small as possible. The reason for this is that the timing prescribed by the timing pulse corresponds to a period for determining application or non-application of the drive signals COM_A and COM_B to the piezo elements PZT with the switches 85A and 85B. More specifically, in this period, the switches 85A and 85B are unstable. The switches 85A and 85B that are used switch application and non-application of the drive signals COM_A and COM_B, for example, by changing a resistance value. In a case where switching is performed between application and non-application, the state becomes unstable until the switching has been completed. In this unstable period, if noise makes the voltage of the first drive signal COM_A different from that of the second drive signal COM_B, through-current may flow due to the voltage difference. Since this through-current is unexpected current, the components constituting the printer 1 may be negatively affected.

In view of these circumstances, in the printer 1, the generation timing is determined as below, regarding first timing pulses at the second and following orders among the first timing pulses for prescribing the generation start timings of the waveform sections SS11 to SS13 in the first drive signal COM_A, and first timing pulses at the second and following orders among the second timing pulses for prescribing the generation start timings of the waveform sections SS21 to SS23 in the second drive signal COM_B.

For example, a first timing pulse at the first order for prescribing the generation start timing of the waveform section SS12 and a second timing pulse at the first order for prescribing the generation start timing of the waveform section SS22 are generated at different timings in an overlap period between predetermined periods, one of the predetermined periods being at the reference voltage from when generation of the first drive pulse PS1 is ended to when generation of the second drive pulse PS2 is started, and the other predetermined period being at the reference voltage from when generation of the fourth drive pulse PS4 is ended to when generation of the fifth drive pulse PS5 is started.

Similarly, a first timing pulse at the second order for prescribing the generation start timing of the waveform section SS13 and a second timing pulse at the second order for prescribing the generation start timing of the waveform section SS23 are generated at different timings in an overlap period between predetermined periods, one of the predetermined periods being at the reference voltage from when generation of the second drive pulse PS2 is ended to when generation of the third drive pulse PS3 is started, and the other predetermined period being at the reference voltage from when generation of the fifth drive pulse PS5 is ended to when generation of the sixth drive pulse PS6 is started.

With this configuration, it is possible to prevent noise generated in the drive signal COM due to the first timing pulse and noise generated in the drive signal COM due to the second timing pulse from being superimposed. Thus, it is possible to prevent the problem that excessively large noise is generated in the drive signals COM, so that it is possible to prevent problems such as ejection failure of ink. Hereinafter, this is described in detail.

Regarding the Drive Signals and the Timing Signals that are Generated

FIG. 12 is a diagram showing the first drive signal COM_A, the second drive signal COM_B, the latch signal LAT, the first change signal CH_A, and the second change signal CH_B that are generated in the dot forming operation.

In the dot forming operation, the first drive signal generating section 70A generates the first drive signal COM_A, and the second drive signal generating section 70B generates the second drive signal COM_B. The first drive signal COM_A and the second drive signal COM_B are generated in synchronization with generation of a latch pulse in the latch signal LAT. More specifically, the CPU 62 starts to read out the first DAC value and the second DAC value from the memory 63 (voltage data memory for drive signals), based on a signal for prescribing a latch timing (at the timing of a rising edge, for example). Then, the first DAC value and the second DAC value that have been read out are output to the digital-analog converter 711A of the first drive signal generating section 70A and the digital-analog converter 711B of the second drive signal generating section 70B. Accordingly, the first drive signal generating section 70A generates the first drive signal COM_A, and the second drive signal generating section 70B generates the second drive signal COM_B.

Furthermore, the CPU 62 of the printer-side controller 60 starts to read out generation data for timing pulses from the memory 63 (generation data memory for timing pulses), based on a signal for prescribing a latch timing. Accordingly, the latch signal (latch pulse), the first change signal CH_A (first change pulse), and the second change signal CH_B (second change pulse) are generated.

Regarding the Detail of the Drive Signals COM_A and COM_B

The first drive signal COM_A has the waveform section SS11 generated in the period T11 that is the first period in the printing period T (repeating period), the waveform section SS12 generated in the period T12 that is the second period, and the waveform section SS13 generated in the period T13 that is the third period. The second drive signal COM_B has the waveform section SS21 generated in the period T21 that is the first period in the printing period T, the waveform section SS22 generated in the period T22 that is the second period, and the waveform section SS23 generated in the period T23 that is the third period. The waveform section SS11 in the first drive signal COM_A has the first drive pulse PS1. Furthermore, the waveform section SS12 has the second drive pulse PS2, and the waveform section SS13 has the third drive pulse PS3. The waveform section SS21 in the second drive signal COM_B has the fourth drive pulse PS4. The waveform section SS22 has the fifth drive pulse PS5, and the waveform section SS23 has the sixth drive pulse PS6.

The drive pulses PS1 to PS6 are voltage change patterns with which the piezo elements PZT are driven to perform desired operations. The start voltage and the end voltage is the same between the drive pulses PS1 to PS6, and these voltages are taken as the reference voltage. Accordingly, the waveform sections SS11 to SS23 having the drive pulses PS1 to PS6 can be said to be a series of signals whose voltages change from the reference voltage, follow voltage change patterns determined in correspondence with operations that are to be performed by the piezo elements PZT, and then return to the reference voltage.

In this embodiment, when the drive pulses PS1 to PS6 are applied, the piezo element PZT is extended and contracted to displace the island section 412*j* in accordance with the voltage waveform of the applied drive pulses. In accordance with the displacement of the island section 412*j*, the volume of the pressure chamber 412*d* changes. For example, the volume of the pressure chamber 412*d* at the reference voltage is taken as the reference volume. If a voltage portion that is higher than the reference voltage in a particular drive pulse is applied to the piezo element PZT, then the piezo element PZT is contracted in the longitudinal direction of the element, thereby displacing the island section 412*j* away from the pressure chamber 412*d*. Thus, the pressure chamber 412*d* is expanded to a volume larger than the reference volume. If a voltage portion that is lower than the reference voltage in a particular drive pulse is applied to the piezo element PZT, then the piezo element PZT is extended in the longitudinal direction of the element, thereby displacing the island section 412*j* toward the pressure chamber 412*d*. Thus, the pressure chamber 412*d* is contracted to a volume smaller than the reference volume. If a rising portion in the voltage of a drive pulse is applied to the piezo element PZT, then the pressure chamber 412*d* is expanded in accordance with the change in the voltage. If a falling portion in the voltage is applied to the piezo element PZT, then the pressure chamber 412*d* is contracted in accordance with the change in the voltage. Furthermore, if a constant voltage portion that is higher than the reference voltage is applied to the piezo element PZT, then the pressure chamber 412*d* is kept at an expanded state in accordance with the voltage. If a constant voltage portion that is lower than the reference voltage is applied to the piezo element PZT, then the pressure chamber 412*d* is kept at a contracted state in accordance with the voltage.

Among the drive pulses PS1 to PS6, the fourth drive pulse PS4 is a slight vibration pulse. When the fourth drive pulse PS4 is applied to the piezo element PZT, the pressure of ink inside the pressure chamber 412*d* slightly fluctuates to the extent that the ink is not ejected, and thus the meniscus is slightly vibrated. More specifically, the fourth drive pulse PS4 is trapezoid, and if its voltage rising portion (portion inclined diagonally upward right) is applied to the piezo element PZT, then the piezo element PZT is contracted in accordance with this change in the voltage. Thus, the pressure chamber 412*d* is expanded to a volume slightly larger than the reference volume. It seems that in accordance with this expansion, the meniscus is slightly pulled toward the pressure chamber 412*d*. Next, a constant voltage portion in the fourth drive pulse PS4 is applied to the piezo element PZT. It seems that in this period, the contracted state of the piezo element PZT is kept, and the meniscus is freely vibrated. Next, a voltage falling portion (portion inclined diagonally downward right) of the fourth drive pulse PS4 is applied to the piezo element PZT. In this period, the piezo element PZT in the contracted state is extended to the reference state. It seems that the pressure chamber 412*d* is accordingly contracted to the reference volume, and the meniscus is slightly pushed toward the outside of the head 41.

When the meniscus is displaced in this manner, ink with increased viscosity that is often present in the vicinity of the nozzle Nz is agitated, and thus the ink can be kept in a good condition. The fourth drive pulse PS4 is a simple pulse for causing the piezo element PZT to expand once and contract once the pressure chamber 412*d*. Thus, a generation period T21*a* of the fourth drive pulse PS4 is set to be shorter than those for the other drive pulses.

The fifth drive pulse PS5 is a pulse for a first small dot. More specifically, the fifth drive pulse PS5 is for causing ink to be ejected in an amount suitable for forming a first small dot. In this embodiment, when the fifth drive pulse PS5 is applied to the piezo element PZT, approximately 1.5 pL of ink is ejected from the nozzle Nz. The fifth drive pulse PS5 is briefly described. With the fifth drive pulse PS5, the pressure chamber 412*d* is expanded from the reference volume to the maximum volume, and then kept at the expanded state. Subsequently, ink is ejected from the nozzle Nz by successively causing the pressure chamber 412*d* to be contracted to the reference volume, expanded to the maximum volume, and then contracted to the minimum volume. Then, the pressure chamber 412*d* is kept at the minimum volume, and expanded to the reference volume. Since the pressure chamber 412*d* is kept at the minimum volume and then expanded to the reference volume, a fluctuation in the pressure of ink inside the pressure chamber 412*d* after ejection of ink is suppressed. With the fifth drive pulse PS5, the pressure chamber 412*d* is expanded from the reference volume to the maximum volume, and then kept at the expanded state. Then, after the expanded state is kept, the pressure chamber 412*d* is successively contracted to the reference volume, expanded to the maximum volume, and then contracted to the minimum volume. Thus, a generation period T22*a* of the fifth drive pulse PS5 is set to be the longest.

The third drive pulse PS3 is a pulse for a second small dot. More specifically, the third drive pulse PS3 is for causing ink to be ejected in an amount suitable for forming a second small dot. In this embodiment, when the third drive pulse PS3 is applied to the piezo element PZT, approximately 3 pL of ink is ejected from the nozzle Nz. The third drive pulse PS3 is briefly described. With the third drive pulse PS3, the pressure chamber 412*d* is expanded from the reference volume to the maximum volume, and then kept at the expanded state. Subsequently, ink is ejected from the nozzle Nz by successively causing the pressure chamber 412*d* to be contracted to the reference volume, expanded to a medium volume, and contracted to the minimum volume. It should be noted that the medium volume is a volume that is larger than the reference volume and smaller than the maximum volume. Then, the pressure chamber 412*d* is kept at the minimum volume, and expanded to the reference volume. Also with the third drive pulse PS3, the pressure chamber 412*d* is expanded from the reference volume to the maximum volume, and then kept at the expanded state. Subsequently, the pressure chamber 412*d* is successively contracted to the reference volume, expanded to the maximum volume, and contracted to the minimum volume. A generation period T13*a* of the third drive pulse PS3 is set to be substantially the same as the generation period T22*a* of the fifth drive pulse PS5.

The other drive pulses, that is, the first drive pulse PS1, the second drive pulse PS2, and the sixth drive pulse PS6 are pulses for a medium dot. When one of these drive pulses is applied to the piezo element PZT, approximately 7 pL of ink is ejected from the nozzle Nz. When two pulses are applied to the piezo element PZT, ink is ejected in a total amount of approximately 14 pL from the nozzle Nz. When three pulses are applied to the piezo element PZT, ink is ejected in a total amount of approximately 21 pL from the nozzle Nz. In this embodiment, when forming a first medium dot, one of these drive pulses is applied to the piezo element PZT. More specifically, the second drive pulse PS2 is applied to the piezo element PZT. Furthermore, when forming a second medium dot, two of these drive pulses are applied to the piezo element PZT. More specifically, the second drive pulse PS2 and the sixth drive pulse PS6 are applied to the piezo element PZT. When forming a large dot, the three drive pulses PS1, PS2, and PS6 are applied to the piezo element PZT.

The drive pulses PS1, PS2, and PS6 have the same voltage waveform (voltage change pattern). Accordingly, they can be said to be for causing the piezo element PZT to perform the same operation. A description is made taking the drive pulse PS1 as an example. With the drive pulse PS1, the pressure chamber 412*d* is expanded from the reference volume to the maximum volume, and then kept at the expanded state. Subsequently, ink is ejected from the nozzle Nz by causing the pressure chamber 412*d* to be contracted to the minimum volume. Then, the pressure chamber 412*d* is kept at the minimum volume, and expanded to the reference volume. Generation periods T11*a*, T12*a*, and T23*a* of the drive pulses PS1, PS2, and PS6 are set to be the same, and to be shorter than the generation period T13*a* of the third drive pulse PS3 and longer than the generation period T21*a* of the fourth drive pulse PS4.

Regarding Operation to Apply Waveform Sections to the Piezo Element PZT

Figures 13A, 13B:
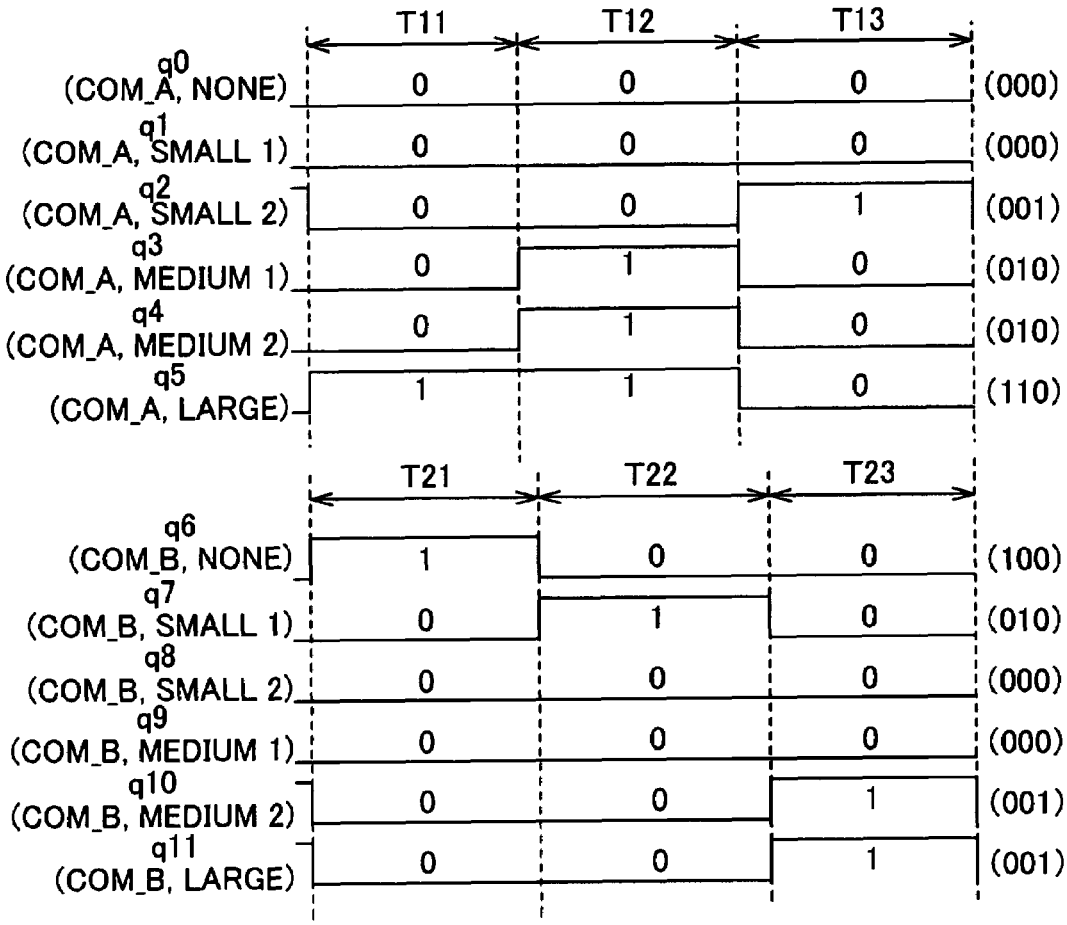
FIG. 13A is a diagram illustrating specific contents of switch operation information.
FIG. 13B is a diagram illustrating a drive pulse that is to be applied and the amount of ink that is to be ejected, for each dot tone.

Next, an operation to apply the waveform sections SS11 to SS23 to the piezo element PZT based on the switch operation information is described. FIG. 13A is a diagram illustrating specific contents of the switch operation information q0 to q11. FIG. 13B is a diagram illustrating a drive pulse that is to be applied and the amount of ink that is to be ejected, for each dot tone (for each dot forming data SI).

As described above, in the printer 1, dots can be formed at six types of dot tone. More specifically, the tone can be controlled in six stages respectively corresponding to formation of no dot (the dot forming data SI [000]), formation of a first small dot (the dot forming data SI [001]), formation of a second small dot (the dot forming data SI [100]), formation of a first medium dot (the dot forming data SI [010]), formation of a second medium dot (the dot forming data SI [101]), and formation of a large dot (the dot forming data SI [011]).

In this case, the switch operation information q0 to q11 is determined as below. More specifically, the switch operation information q0 and the switch operation information q6, which are corresponding to the dot forming data SI for forming no dot, are respectively data [000] and data [100]. The switch operation information q1 and the switch operation information q7, which are corresponding to the dot forming data SI for forming a first small dot, are respectively data [000] and data [010]. The switch operation information q2 and the switch operation information q8, which are corresponding to the dot forming data SI for forming a second small dot, are respectively data [001] and data [000]. The switch operation information q3 and the switch operation information q9, which are corresponding to the dot forming data SI for forming a first medium dot, are respectively data [010] and data [000]. The switch operation information q4 and the switch operation information q10, which are corresponding to the dot forming data SI for forming a second medium dot, are respectively data [010] and data [001]. The switch operation information q5 and the switch operation information q11, which are corresponding to the dot forming data SI for forming a large dot, are respectively data [110] and data [001].

Accordingly, when forming no dot, the waveform section SS21 of the second drive signal COM_B is applied to the piezo element PZT, and the meniscus is slightly vibrated based on the voltage change pattern of the fourth drive pulse PS4. When forming a first small dot, the waveform section SS22 of the second drive signal COM_B is applied to the piezo element, and approximately 1.5 pL of ink is ejected based on the voltage change pattern of the fifth drive pulse PS5. When forming a second small dot, the waveform section SS13 of the first drive signal COM_A is applied to the piezo element PZT, and approximately 3 pL of ink is ejected based on the voltage change pattern of the third drive pulse PS3. When forming a first medium dot, the waveform section SS12 of the first drive signal COM_A is applied to the piezo element PZT, and approximately 7 pL of ink is ejected based on the voltage change pattern of the second drive pulse PS2. When forming a second medium dot, the waveform section SS12 of the first drive signal COM_A and the waveform section SS23 of the second drive signal COM_B are applied to the piezo element PZT, and approximately 14 pL of ink is ejected based on the voltage change patterns of the second drive pulse PS2 and the sixth drive pulse PS6. When forming a large dot, the waveform section SS11 and the waveform section SS12 of the first drive signal COM_A and the waveform section SS23 of the second drive signal COM_B are applied to the piezo element PZT, and approximately 21 pL of ink is ejected based on the voltage change patterns of the first drive pulse PS1, the second drive pulse PS2, and the sixth drive pulse PS6.

Timing Pulses

Regarding the Timing Pulses

Herein, the timing pulse is described. As shown in the description above, application or non-application of the first drive signal COM_A to the piezo element PZT is selected at the generation timing of the latch pulse and the generation timing of the first change pulse. Thus, the latch pulse and the first change pulse correspond to the first timing pulses for prescribing the generation start timings of the first waveform sections in the first drive signal COM_A. Similarly, application or non-application of the second drive signal COM_B to the piezo element PZT is selected at the generation timing of the latch pulse and the generation timing of the second change pulse. Thus, the latch pulse and the second change pulse correspond to the second timing pulses for prescribing the generation start timings of the second waveform sections in the second drive signal COM_B.

Herein, the latch pulse is used for each of the first drive signal COM_A and the second drive signal COM_B, and is for prescribing the generation start timing of the waveform section (the waveform section SS11, SS21) that is to be generated first. Then, the first change pulses prescribe the generation start timings of the first waveform sections that are to be generated second and thereafter. In the example shown in FIG. 12, the first change pulse at the first order prescribes the generation start timing of the waveform section SS12 that is to be generated second, and the first change pulse at the second order prescribes the generation start timing of the waveform section SS13 that is to be generated third. Thus, the first change pulses correspond to the first timing pulses corresponding to first waveform sections that are different from a particular first waveform section and that are generated after the particular first waveform section. Similarly, the second change pulses prescribe the generation start timings of the second waveform sections (the waveform sections SS22 and SS23) that are to be generated second and thereafter. Thus, the second change pulses correspond to the second timing pulses corresponding to second waveform sections that are different from a particular second waveform section and that are generated after the particular second waveform section.

In this embodiment, generation of the waveform sections SS11, SS12 is started at the timing of a rising edge in the latch pulse. The reason for this is that reading out of the first DAC value and the second DAC value stored in the memory 63 (voltage data memory for drive signals) is started in synchronization with the rising edge. Furthermore, the switch operation information q0 to q11 corresponding to the period T11, T21 is output at this timing. The reason for this is that the first counter CTA and the second counter CTB in the control logic 83 are reset when the rising edge in the latch pulse is input.

Generation of the waveform section SS12 is started at the timing of a rising edge in the first change pulse at the first order, and generation of the waveform section SS13 is started at the timing of a rising edge in the first change pulse at the second order. The first counter CTA increases its count when the rising edge in first change pulse is input, and the register is switched to a register RG that is to be selected. Similarly, generation of the waveform section SS22 is started at the timing of a rising edge in the second change pulse at the first order, and generation of the waveform section SS23 is started at the timing of a rising edge in the second change pulse at the second order. The second counter CTB increases its count when the rising edge in the second change pulse is input, and the register is switched to a register RG that is to be selected.

Figure 14:
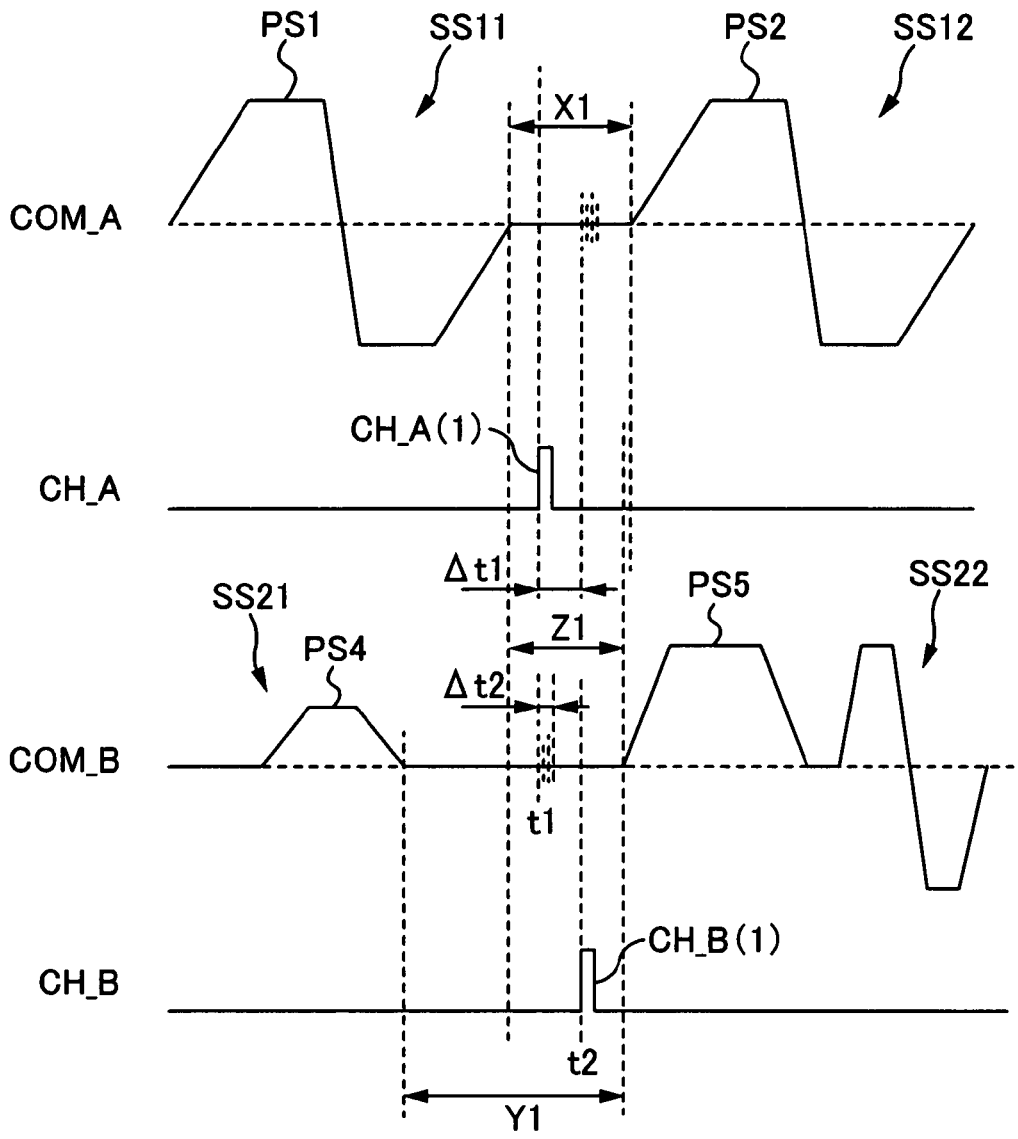
FIG. 14 is a diagram illustrating the relationship between a first change pulse at the first order and a second change pulse at the first order.

Regarding the Relationship Between the First Change Pulse at the First Order and the Second Change Pulse at the First Order FIG. 14 is a diagram illustrating the relationship between a first change pulse CH_A (1) at the first order and a second change pulse CH_B (1) at the first order. The waveform section SS12 corresponding to the first change pulse CH_A (1) at the first order is for applying the second drive pulse PS2 to the piezo element PZT. From this point of view, it is sufficient that generation of the waveform section SS12 is started in a period X1 in which a constant signal is generated at the reference voltage, from the generation end timing of the first drive pulse PS1 to the generation start timing of the second drive pulse PS2. Accordingly, it is sufficient that the first change pulse CH_A (1) at the first order is generated in the period X1. In this example, it is sufficient that its rising edge is generated in the period X1.

The waveform section SS22 corresponding to the second change pulse CH_B (1) at the first order is for applying the fifth drive pulse PS5 to the piezo element PZT. From this point of view, it is sufficient that generation of the waveform section SS22 is started in a period Y1 in which a constant signal is generated at the reference voltage, from the generation end timing of the fourth drive pulse PS4 to the generation start timing of the fifth drive pulse PS5. Accordingly, it is sufficient that the second change pulse CH_B (1) at the first order is generated in the period Y1. In this example, it is sufficient that its rising edge is generated in the period Y1.

Herein, as described above, noise may be generated in the drive signals COM_A and COM_B at the generation timings of the change pulses. The noise disturbs the waveforms of the drive signals COM_A and COM_B, and thus it is preferable that no noise is generated in the generation periods of the drive pulses. The reason for this is that if a drive pulse with a disturbed waveform is applied to the piezo element PZT, then the piezo element PZT may perform an unexpected operation, causing problems in ejection of ink. For example, in a period from the start timing of the period Y1 to the start timing of the period X1, a portion of the first drive pulse is generated. More specifically, generated are a lowest voltage portion for keeping the pressure chamber 412*d* at a contracted volume after ejection of ink, and a voltage portion rising from the lowest voltage to the reference voltage in order to expand the pressure chamber 412*d* at the contracted volume to the reference volume. In a case where the second change pulse CH_B (1) at the first order is generated in this period, noise may make it impossible to keep the pressure chamber 412*d* at the contracted volume, or may pose a problem for an operation to expand the pressure chamber 412*d* to the reference volume. In order to avoid these problems, the first change pulse CH_A (1) at the first order and the second change pulse CH_B (1) at the first order are generated in an overlap period Z1 between the period X1 and the period Y1.

However, even in the period Z1, in a case where the second change pulse CH_B (1) at the first order and the second change pulse CH_B (1) at the first order are simultaneously generated, noise generated due to the second change pulse CH_B (1) at the first order and noise generated due to the second change pulse CH_B (1) at the first order may be superimposed. For example, if changes in the voltages of the drive signals COM_A and COM_B caused by the noise have the same phase, then the changes in the voltages are increased by the noise.

In view of these circumstances, in the printer 1, the first change pulse CH_A (1) at the first order and the second change pulse CH_B (1) at the first order are generated at different timings in the period Z1. Herein, the term "different timings" refers to different generation timings of control triggers. In this example, the rising edges in the change pulses serve as the control triggers. Thus, the change pulses are generated such that the timings of the edges are different from each other. More specifically, the first change pulse CH_A (1) at the first order is generated such that its rising edge is at a timing t1. The second change pulse CH_B (1) at the first order is generated such that its rising edge is at a timing t2.

The difference between the timings of the change pulses is most preferably set to be equal to or larger than the time during which noise generated by the first change pulse CH_A (1) at the first order is cancelled. Thus, even when noise is generated in the drive signals COM_A and COM_B due to the second change pulse CH_B (1) at the first order, the noise is not affected by the previously generated noise. As a result, noise generated in the drive signals COM_A and COM_B is at the level of noise generated by one change pulse, and thus it is possible to prevent the problem that noise is superimposed to be excessively large. In this example, a difference Δt1 between timings is set to be longer than a generation period Δt2 of noise. Accordingly, after noise generated by the first change pulse CH_A (1) at the first order has been cancelled, the second change pulse CH_B (1) at the first order is generated, and thus it is possible to reliably prevent noise from being superimposed. It should be noted that the generation period Δt2 of noise may be obtained by actual measurement or simulation.

Furthermore, regarding the generation start timing of the second change pulse CH_B (1) at the first order, it is necessary to take the generation start timings of the second drive pulse PS2 in the first drive signal COM_A and the fifth drive pulse PS5 in the second drive signal COM_B into consideration. More specifically, it is preferable that noise generated due to the second change pulse CH_B (1) at the first order does not disturb the waveform of the second drive pulse PS2 or the fifth drive pulse PS5. From this point of view, it is preferable that the second change pulse CH_B (1) at the first order is generated after noise generated by this change pulse has been cancelled, at the generation start timing of the second drive pulse PS2 or the fifth drive pulse PS5.

It should be noted that even in a case where noise generated by the first change pulse CH_A (1) at the first order has not been cancelled, if the noise does not increase noise generated by the second change pulse CH_B (1) at the first order, the negative influence of noise can be prevented.

Figure 15:
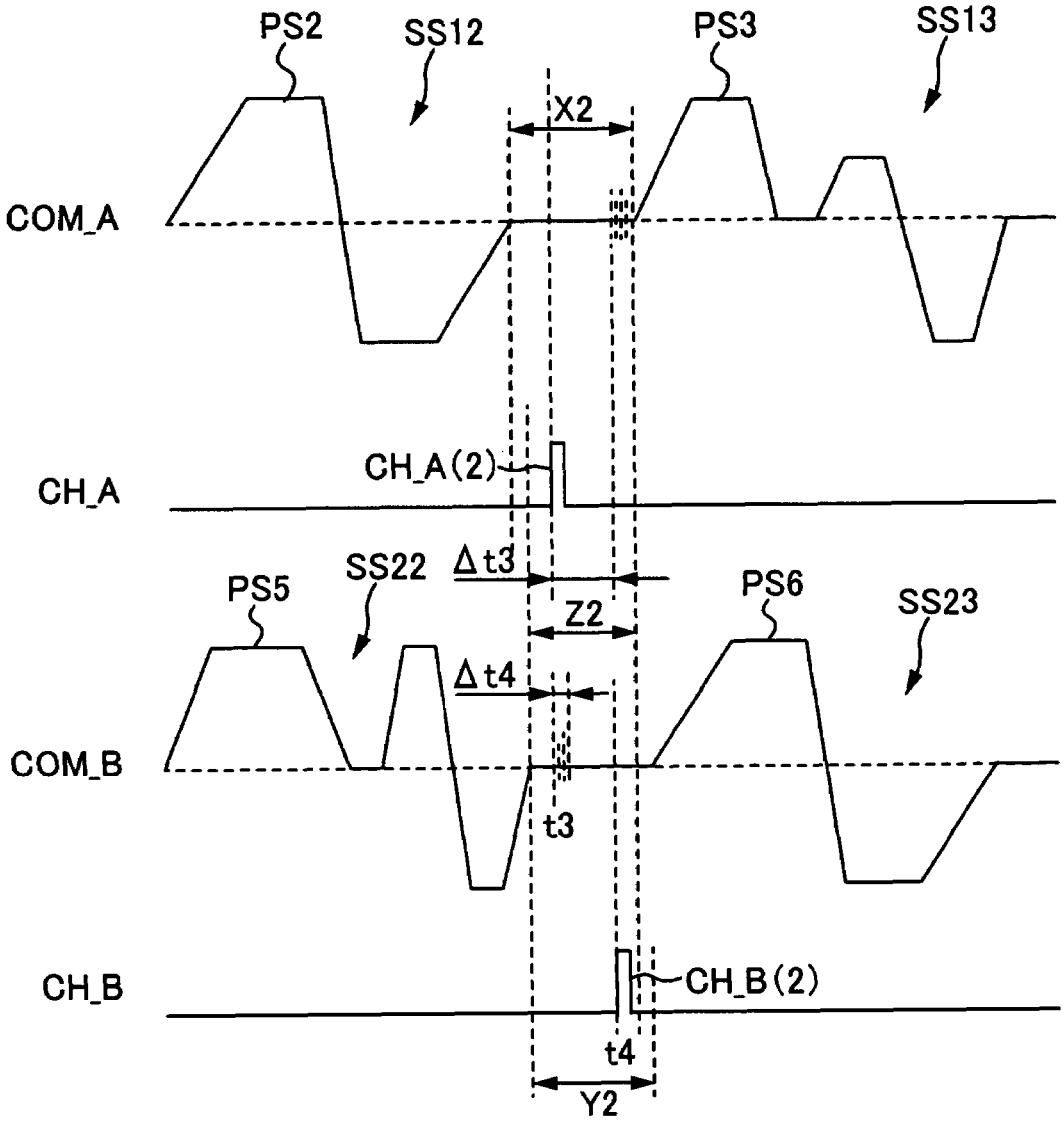
FIG. 15 is a diagram illustrating the relationship between a first change pulse at the second order and a second change pulse at the second order.

Regarding the Relationship Between the First Change Pulse at the Second Order and the Second Change Pulse at the Second Order FIG. 15 is a diagram illustrating the relationship between a first change pulse CH_A (2) at the second order and a second change pulse CH_B (2) at the second order.

The first change pulse CH_A (2) at the second order is for prescribing the generation start timing of the waveform section SS13. It is sufficient that generation of the waveform section SS13 is started in a period X2 in which a constant signal is generated at the reference voltage, from the generation end timing of the second drive pulse PS2 to the generation start timing of the third drive pulse PS3. Accordingly, it is sufficient that the rising edge of the first change pulse CH_A (2) at the second order is generated in the period X2. The second change pulse CH_B (2) at the second order is for prescribing the generation start timing of the waveform section SS23. It is sufficient that generation of the waveform section SS23 is started in a period Y2 in which a constant signal is generated at the reference voltage, from the generation end timing of the fifth drive pulse PS5 to the generation start timing of the sixth drive pulse PS6. Accordingly, it is sufficient that the rising edge of the second change pulse CH_B (2) at the second order is generated in the period Y2.

Herein, regarding noise generated in the drive signals COM_A and COM_B due to the change pulses CH_A (2) and CH_B (2), there is a problem as in the first change pulse CH_A (1) at the first order and the second change pulse CH_B (1) at the first order. Thus, in this example, the change pulses CH_A (2) and CH_B (2) are generated at different timings in an overlap period Z2 between the period X2 and the period Y2. More specifically, the first change pulse CH_A (2) at the second order is generated such that its rising edge is at a timing t3. The second change pulse CH_B (2) at the second order is generated such that its rising edge is at a timing t4. A difference Δt3 between timings of the change pulses CH_A (2) and CH_B (2) is set to be longer than a generation period Δt4 of noise generated due to the first change pulse CH_A (2) at the second order.

As a result, it is possible to prevent the problem that noise generated in the drive signals COM_A and COM_B is superimposed to be excessively large.

Regarding Application of the Waveform Sections SS12 and SS23

Figure 16:
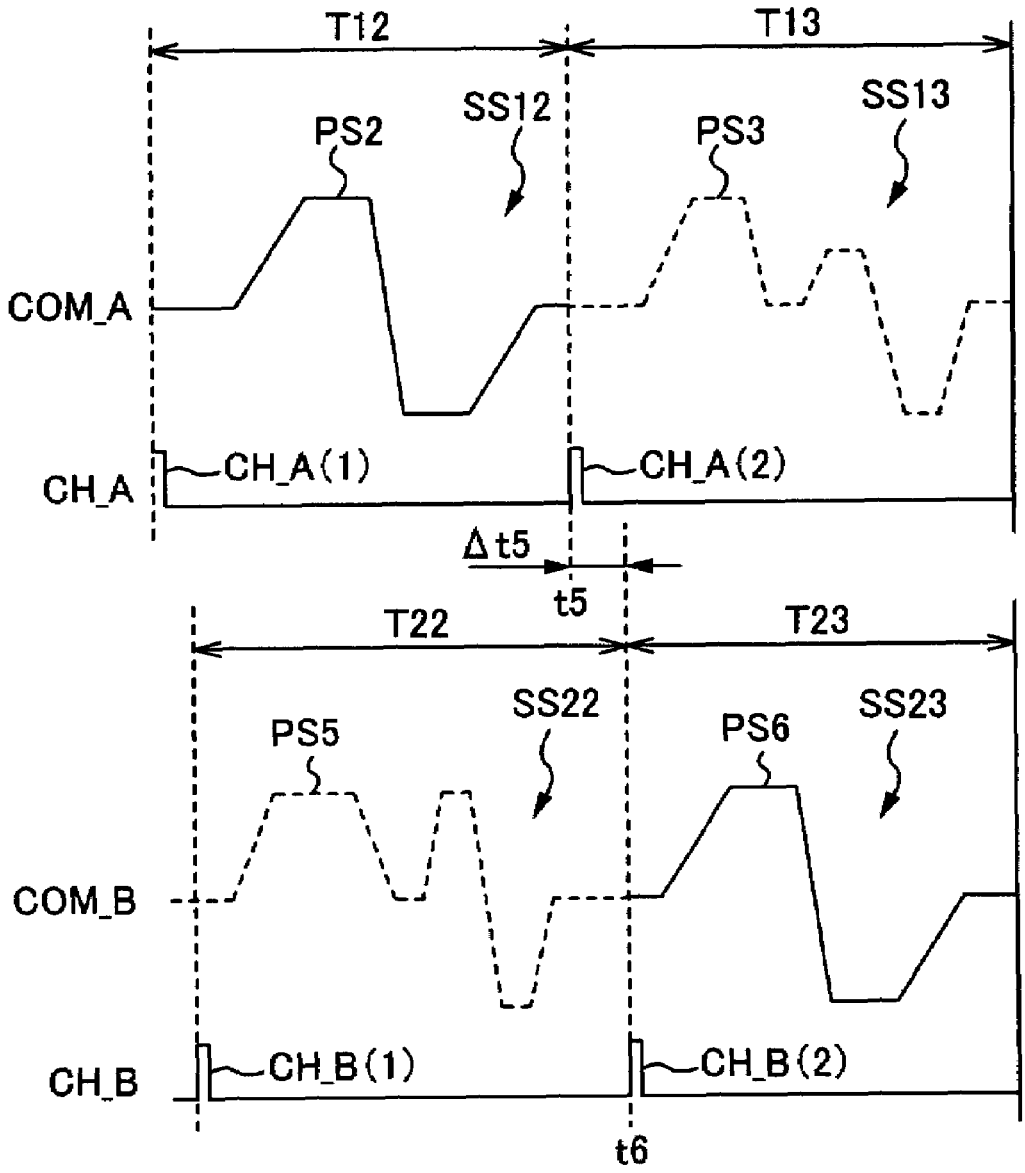
FIG. 16 is a diagram illustrating application of a waveform section SS12 and a waveform section SS23 to a piezo element when forming a second medium dot or a large dot.

FIG. 16 is a diagram illustrating application of the waveform section SS12 and the waveform section SS23 to the piezo element PZT when forming a second medium dot or large dot.

When forming a second medium dot or large dot, after application of the waveform section SS12 in the first drive signal COM_A, the waveform section SS23 in the second drive signal COM_B is applied to the piezo element PZT. Herein, the second change pulse CH_B (2) at the second order is generated after the first change pulse CH_A (2) at the second order. More specifically, in a case where a second waveform section that is different from a particular first waveform section is applied to the piezo element PZT after the particular first waveform section is applied to the piezo element PZT, a second timing pulse corresponding to this different second waveform section is generated after a first timing pulse corresponding to another first waveform section (the waveform section SS13).

In this case, when forming a second medium dot or large dot, application of the waveform section SS12 (the first drive signal COM_A) to the piezo element PZT is ended at a timing t5. Then, at a timing t6, application of the waveform section SS23 (the second drive signal COM_B) to the piezo element PZT is started. Accordingly, throughout a period Δt5, neither of the drive signals COM_A and COM_B is applied to the piezo element PZT forming a second medium dot or large dot.

Thus, it is possible to reliably prevent the problem that the drive signals COM_A and COM_B are simultaneously applied to the piezo element PZT. As a result, it is possible to reliably prevent the problem that unexpected through-current flows in the first current amplifying circuit 72A or the second current amplifying circuit 72B, due to the voltage difference between the first drive signal COM_A and the second drive signal COM_B.

SUMMARY

The following effects are achieved in the thus configured first embodiment.

The printer 1 of the first embodiment has (A) the drive signal generating circuit 70, (B) the timing pulse generating section (the printer-side controller 60), and (C) the head controller HC.

The drive signal generating circuit 70 simultaneously generates, in the printing period T, the first drive signal COM_A having the waveform sections SS11 to SS13 whose voltages change from the reference voltage, follow voltage change patterns (that is, the drive pulses PS1 to PS3) determined in correspondence with operations that are to be performed by the piezo element PZT, and then return to the reference voltage, and the second drive signal COM_B having the waveform sections SS21 to SS23 whose voltages change from the reference voltage, follow voltage change patterns (the drive pulses PS4 to PS6) determined in correspondence with operations that are to be performed by the piezo element PZT, and then return to the reference voltage.

The timing pulse generating section generates a plurality of pulses, that is, the latch pulse, the first change pulse CH_A (1) at the first order, and the first change pulse CH_A (2) at the second order, which indicate the generation start timings of the waveform sections SS11 to SS13, respectively in correspondence with the waveform sections SS11 to SS13, and generates the latch pulse, the second change pulse CH_B (1) at the first order, and the second change pulse CH_B (2) at the second order, which indicate the generation start timings of the waveform sections SS21 to SS23, respectively in correspondence with the waveform sections SS21 to SS23.

Furthermore, the timing pulse generating section generates the first change pulse CH_A (1) at the first order corresponding to the waveform section SS12 that is generated subsequently after the waveform section SS11, and the second change pulse CH_B (1) at the first order corresponding to the waveform section SS22 that is generated subsequently after the waveform section SS21, at different timings in the overlap period Z1 between the period X1 and the period Y1, the period X1 being from the generation end timing of the first drive pulse PS1 to the generation start timing of the second drive pulse PS2, and the period Y1 being from the generation end timing of the fourth drive pulse PS4 to the generation start timing of the fifth drive pulse PS5.

Similarly, the timing pulse generating section generates the first change pulse CH_A (2) at the second order corresponding to the waveform section SS13 that is generated subsequently after the waveform section SS12, and the second change pulse CH_B (2) at the second order corresponding to the waveform section SS23 that is generated subsequently after the waveform section SS22, at different timings in the overlap period Z2 between the period X2 and the period Y2, the period X2 being from the generation end timing of the second drive pulse PS2 to the generation start timing of the third drive pulse PS2, and the period Y2 being from the generation end timing of the fourth drive pulse PS4 to the generation start timing of the fifth drive pulse PS5.

The head controller HC applies either the waveform sections SS11 to SS13 or the waveform sections SS21 to SS23 to the piezo element PZT, at a timing prescribed by either the first timing pulses or the second timing pulses, thereby causing the piezo element PZT to operate in response to the drive pulses PS1 to PS6 of the applied waveform section.

In the printer 1, the first change pulse CH_A (1) at the first order and the second change pulse CH_B (1) at the first order are generated at different timings in the period Z1, and thus it is possible to prevent noise generated due to the change pulses from being superimposed. Similarly, the first change pulse CH_A (2) at the second order and the second change pulse CH_B (2) at the second order are generated at different timings in the period Z2, and thus it is possible to prevent noise generated due to the change pulses from being superimposed.

Furthermore, in the printer 1 of the first embodiment, the generation period of at least one of the drive pulses PS1 to PS3 respectively in the waveform sections SS11 to SS13 is different from the generation period of at least one of the drive pulses PS4 to PS6 respectively in the waveform sections SS21 to SS23. More specifically, as shown in FIG. 12, the generation period T11*a* of the first drive pulse PS1 and the generation period T12*a* of the second drive pulse PS2 are different from the generation period T21*a* of the fourth drive pulse PS4, and different also from the generation period T22*a* of the fifth drive pulse PS5. With the configuration of this embodiment, problems caused due to noise can be suppressed. Thus, it is possible to efficiently generate a plurality of waveform sections while suppressing the influence of noise, even in a limited printing period T.

Furthermore, in the printer 1, the first drive signal COM_A and the second drive signal COM_B contain drive pulses (the drive pulses PS1 to PS3, PS5, and PS6) for causing different amounts of ink to be ejected, and a drive pulse (the drive pulse PS4) for causing the meniscus to be slightly vibrated. Thus, it is possible to cause the head 41 to perform various operations even in a limited printing period T.

Regarding Other Embodiments

The foregoing embodiment primarily describes the printing system 100 that has the printer 1 as a liquid ejecting apparatus, but it also includes the disclosure of methods for ejecting liquid and liquid ejection systems, for example. In addition to this, it also includes the disclosure of control devices for controlling liquid ejection heads and programs and codes for controlling liquid ejecting apparatuses and control devices. Moreover, this embodiment is for the purpose of elucidating the present invention, and is not to be interpreted as limiting the present invention. It goes without saying that the present invention can be altered and improved without departing from the gist thereof and includes functional equivalents. In particular, embodiments described below are also included in the present invention.

Regarding the Drive Signals

In the first embodiment described above, the first drive signal COM_A had three waveform section SS11 to S13, and the second drive signal COM_B also had three waveform section SS21 to S23. However, the number of waveform sections is not limited to this. For example, it is possible to apply any configuration in a similar manner, as long as the first drive signal COM_A and the second drive signal COM_B have a plurality of waveform sections.

Furthermore, in the first embodiment, as an example, the configuration was shown in which two types of drive signals, that is, the first drive signal COM_A and the second drive signal COM_B were simultaneously generated throughout a printing period T. However, the number of the types of the drive signals COM is not limited to two, and it is possible to apply, in a similar manner, a configuration with three or more types of the drive signals COM.

Regarding the Change Pulses

In the first embodiment described above, a first change pulse corresponding to the first drive signal COM_A was generated before a second change pulse corresponding to the second drive signal COM_B. Regarding this point, it is also possible to apply a configuration in which the second change pulse is generated before the first change pulse. In this case, if a waveform section applied to the piezo element PZT is switched from a waveform section in the first drive signal COM_A to a waveform section in the second drive signal COM_B as in the first embodiment, then the first change pulse is generated before the second change pulse, in order to prevent the problem that through-current flows because the first drive signal COM_A and the second drive signal COM_B are simultaneously applied to the piezo element PZT.

Regarding Element that Performs an Operation for Causing Ink to be Ejected

The piezo element PZT in the first embodiment was for expanding the pressure chamber 412*d* in accordance with an increase in the potential, and for contracting the pressure chamber 412*d* in accordance with a decrease in the potential. It is also possible to use a piezo element that contracts the pressure chamber 412*d* in accordance with an increase in the potential, and expands the pressure chamber 412*d* in accordance with a decrease in the potential. Furthermore, it seems that as an element that performs an operation for causing ink to be ejected, a similar effect is achieved as long as the element is affected by noise. For example, it seems that a similar effect is achieved with a heater element.

Other Exemplary Applications

In the foregoing embodiment, as an example, the printer 1 was shown that performed printing while moving the carriage CR to which the head 41 (the head unit 40) was attached in the carriage movement direction, but the printer is not limited to this configuration. For example, it is also possible to apply, in a similar manner, a printer having a line head in which the head 41 (the nozzles Nz) is disposed in a direction intersecting (more preferably, perpendicular to) the transport direction of paper S.

In the foregoing embodiment, the printer 1 was described as a liquid ejecting apparatus, but this is not a limitation. For example, the same technology as that of this embodiment can also be applied to various types of liquid ejecting apparatuses that employ inkjet technology, including color filter manufacturing apparatuses, dyeing apparatuses, fine processing apparatuses, semiconductor manufacturing apparatuses, surface processing apparatuses, three-dimensional shape forming machines, liquid vaporizing apparatuses, organic EL manufacturing apparatuses (in particular, macromolecular EL manufacturing apparatuses), display manufacturing apparatuses, film formation apparatuses, and DNA chip manufacturing apparatuses. Moreover, methods and manufacturing methods of these are also within the scope of application.

What is claimed is:

1. A liquid ejection head control method, comprising:

(A) simultaneously generating a first drive signal and a second drive signal in a particular period, wherein the first drive signal has a plurality of first waveform sections whose voltages change from a reference voltage, follow voltage change patterns determined in correspondence with operations to be performed by an element that is in the liquid ejection head and that performs at least an operation for causing liquid to be ejected, and then return to the reference voltage, and the second drive signal has a plurality of second waveform sections whose voltages change from the reference voltage, follow voltage change patterns determined in correspondence with operations to be performed by the element, and then return to the reference voltage;

(B) generating a plurality of first timing pulses that indicate generation start timings of the first waveform sections, respectively in correspondence with the plurality of first waveform sections, and generating a plurality of second timing pulses that indicate generation start timings of the second waveform sections, respectively in correspondence with the plurality of second waveform sections, wherein the first timing pulse corresponding to a first waveform section that is different from a particular first waveform section and that is generated subsequently after the particular first waveform section, and the second timing pulse corresponding to a second waveform section that is different from a particular second waveform section and that is generated subsequently after the particular second waveform section are generated at different timings, in an overlap period between generation periods of the reference voltage, one of the generation periods being from a generation end timing of the voltage change pattern in the particular first waveform section to a generation start timing of the voltage change pattern in the different first waveform section, the other generation period being from a generation end timing of the voltage change pattern in the particular second waveform section to a generation start timing of the voltage change pattern in the different second waveform section; and (C) applying either one of the first waveform section and the second waveform section to the element at a timing prescribed by either one of the first timing pulse and the second timing pulse, thereby causing the element to operate in accordance with the voltage change pattern in the applied waveform section.

2. A liquid ejection head control method according to claim 1, wherein first selection data for selecting the first waveform section is updated at a timing prescribed by the first timing pulse, and application of the first drive signal to the element is controlled based on the first selection data, and second selection data for selecting the second waveform section is updated at a timing prescribed by the second timing pulse, and application of the second drive signal to the element is controlled based on the second selection data.

3. A liquid ejection head control method according to claim 2, wherein the first selection data is updated at a timing of an edge in the first timing pulse, the second selection data is updated at a timing of an edge in the second timing pulse, and the first timing pulse corresponding to the different first waveform section and the second timing pulse corresponding to the different second waveform section are generated at different timings such that the timing of the edge in the first timing pulse is different from the timing of the edge in the second timing pulse.

4. A liquid ejection head control method according to claim 1, wherein in a case where the different second waveform section is applied to the element after the particular first waveform section is applied to the element, the second timing pulse corresponding to the different second waveform section is generated after the first timing pulse corresponding to the different first waveform section.

5. A liquid ejection head control method according to claim 1, wherein a generation period of at least one of the voltage change patterns respectively in the plurality of first waveform sections is made different from a generation period of at least one of the voltage change patterns respectively in the plurality of second waveform sections.

6. A liquid ejection head control method according to claim 1, wherein the liquid ejection head is for changing a volume of a pressure chamber that is in communication with a nozzle, with an operation of the element, at least one of the voltage change patterns respectively in the plurality of first waveform sections and the plurality of second waveform sections is for changing the volume of the pressure chamber such that a predetermined amount of liquid is ejected from the nozzle, and at least another one of the voltage change patterns is for changing the volume of the pressure chamber to the extent that liquid is not ejected from the nozzle.

7. A liquid ejection head control method according to claim 1, wherein the first drive signal and the second drive signal are repeatedly generated taking the particular period as a repeating unit.

8. A liquid ejection head control method according to claim 7, wherein the first drive signal and the second drive signal are generated by reading, every update cycle, data that is stored for each update cycle and that indicates the voltage of the first drive signal in the particular period, and data that is stored for each update cycle and that indicates the voltage of the second drive signal in the particular period, and the first timing pulses and the second timing pulses are generated by reading, every update cycle, data that is stored for each update cycle and that indicates a generation state of the first timing pulses in the particular period, and data that is stored for each update cycle and that indicates a generation state of the second timing pulses in the particular period.

9. A liquid ejection head control apparatus, comprising:

(A) a drive signal generating section for simultaneously generating a first drive signal and a second drive signal in a particular period, wherein the first drive signal has a plurality of first waveform sections whose voltages change from a reference voltage, follow voltage change patterns determined in correspondence with operations to be performed by an element that is in the liquid ejection head and that performs at least an operation for causing liquid to be ejected, and then return to the reference voltage, and the second drive signal has a plurality of second waveform sections whose voltages change from the reference voltage, follow voltage change patterns determined in correspondence with operations to be performed by the element, and then return to the reference voltage;

(B) a timing pulse generating section for generating a plurality of first timing pulses that indicate generation start timings of the first waveform sections, respectively in correspondence with the plurality of first waveform sections, and generating a plurality of second timing pulses that indicate generation start timings of the second waveform sections, respectively in correspondence with the plurality of second waveform sections, wherein the first timing pulse corresponding to a first waveform section that is different from a particular first waveform section and that is generated subsequently after the particular first waveform section, and the second timing pulse corresponding to a second waveform section that is different from a particular second waveform section and that is generated subsequently after the particular second waveform section are generated at different timings, in an overlap period between generation periods of the reference voltage, one of the generation periods being from a generation end timing of the voltage change pattern in the particular first waveform section to a generation start timing of the voltage change pattern in the different first waveform section, the other generation period being from a generation end timing of the voltage change pattern in the particular second waveform section to a generation start timing of the voltage change pattern in the different second waveform section; and (C) a signal applying section for applying the first waveform sections and the second waveform sections to the element, wherein the signal applying section applies either one of the first waveform section and the second waveform section to the element at a timing prescribed by either one of the first timing pulse and the second timing pulse, thereby causing the element to operate in accordance with the voltage change pattern in the applied waveform section.

* * * * *